US006853307B2

(12) United States Patent
Nickerson

(10) Patent No.: US 6,853,307 B2
(45) Date of Patent: Feb. 8, 2005

(54) HIGH VOLTAGE PROXIMITY WARNING SYSTEM AND METHOD

(76) Inventor: Irvin H. Nickerson, 819 Peacock Plz., #562, Key West, FL (US) 33040

( * ) Notice: Subject to any disclaimer, the term of this patent is extended or adjusted under 35 U.S.C. 154(b) by 167 days.

(21) Appl. No.: 10/383,187

(22) Filed: Mar. 5, 2003

(65) Prior Publication Data

US 2003/0174061 A1 Sep. 18, 2003

Related U.S. Application Data

(60) Provisional application No. 60/364,980, filed on Mar. 14, 2002.

(51) Int. Cl.[7] ..... G08B 21/00

(52) U.S. Cl. ..... 340/685; 340/551; 340/552; 340/561; 340/562; 340/686.5; 340/686.6; 340/664; 340/654; 340/649; 340/662; 340/691.4; 340/691.6

(58) Field of Search ..... 340/685, 551, 340/552, 561, 562, 664, 662, 654, 691.4, 691.6, 686.5, 686.6

(56) References Cited

U.S. PATENT DOCUMENTS

| | | | | |
|---|---|---|---|---|
| 2,615,969 A | | 10/1952 | Albrecht | |
| 2,730,245 A | | 1/1956 | Auld | |
| 2,789,282 A | | 4/1957 | Winters | |
| 3,125,751 A | | 3/1964 | Winters | |
| 3,141,156 A | | 7/1964 | Freedman et al. | |
| 3,168,729 A | | 2/1965 | Volberg | |
| 3,201,775 A | | 8/1965 | Pedersen | |
| 3,733,597 A | | 5/1973 | Healey et al. | |
| 3,745,549 A | * | 7/1973 | Jepperson et al. | 340/514 |
| 3,786,468 A | | 1/1974 | Moffitt | |
| 3,833,898 A | | 9/1974 | Wilkinson | |
| 4,064,997 A | | 12/1977 | Holland et al. | |
| 4,408,195 A | | 10/1983 | Tullis et al. | |
| 4,649,375 A | * | 3/1987 | Duppong et al. | 340/660 |
| 4,675,664 A | | 6/1987 | Cloutier et al. | |
| 5,001,465 A | * | 3/1991 | Siegel | 340/685 |
| 6,600,426 B1 | * | 7/2003 | Sacks et al. | 340/664 |

FOREIGN PATENT DOCUMENTS

| | | |
|---|---|---|
| AU | 261364 | 10/1964 |
| CA | 758721 | 5/1967 |
| CA | 963553 | 2/1975 |
| FR | 1363156 | 9/1964 |
| GB | 1061753 | 3/1967 |
| GB | 1367641 | 9/1974 |
| GB | 1367642 | 9/1974 |

* cited by examiner

*Primary Examiner*—Daniel Wu
*Assistant Examiner*—Tai Tan Nguyen

(57) ABSTRACT

A high-voltage-proximity warning system has a local panel (1) for being positioned in or about a cab (2) of heavy equipment or other vehicle (5), a remote panel (3) in predetermined electrical communication with the local panel and one or more proximity antennas (4) for being positioned selectively on the vehicle in predetermined electrical communication with the local panel. The local panel is adapted to be push-button operable conveniently by an operator with gloved hands in a position where it is readily visible and easily connectable electrically to the remote panel and to the one or more proximity antennas. The remote panel is adapted to be positioned on or off of the vehicle where it can be protected for supportive operation and accessed for plural electrical connection to electrical devices that can include an electrical-source terminal (11), to speakers, and to warning and alarm communication devices (50). A method for use includes placing the local panel suitably for access by the vehicle operator in or about the cab, placing the remote panel suitably for access by a user technician in the vicinity of the local panel, setting control levels of high-voltage sensing and alarm control by the user technician, adjusting the alarm setpoint by the operator within the control levels set by the user technician in a configuration mode and connecting the system to an ignition terminal (51) and to the communication devices which can be customized for use conditions.

53 Claims, 11 Drawing Sheets

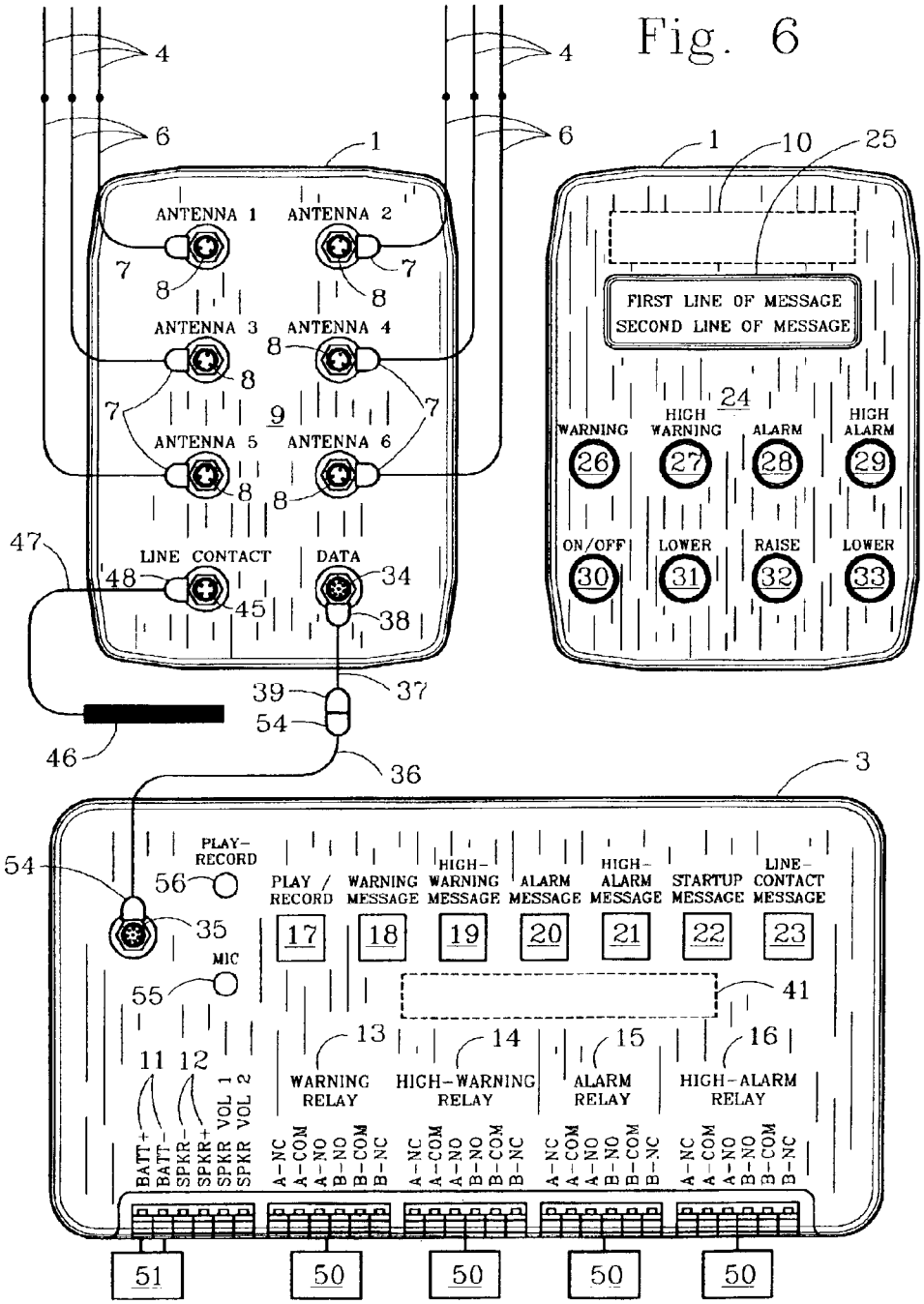
Fig. 6
ANTENNA 1
ANTENNA 2
ANTENNA 3
ANTENNA 4
ANTENNA 5
ANTENNA 6
LINE CONTACT
DATA
FIRST LINE OF MESSAGE
SECOND LINE OF MESSAGE
WARNING
HIGH WARNING
ALARM
HIGH ALARM
ON/OFF
LOWER
RAISE
LOWER
PLAY-RECORD
MIC
PLAY / RECORD
WARNING MESSAGE
HIGH-WARNING MESSAGE
ALARM MESSAGE
HIGH-ALARM MESSAGE
STARTUP MESSAGE
LINE-CONTACT MESSAGE
WARNING RELAY
HIGH-WARNING RELAY
ALARM RELAY
HIGH-ALARM RELAY
BATT+
BATT-
SPKR-
SPKR+
SPKR VOL 1
SPKR VOL 2
A-NC
A-COM
A-NO
B-NO
B-COM
B-NC

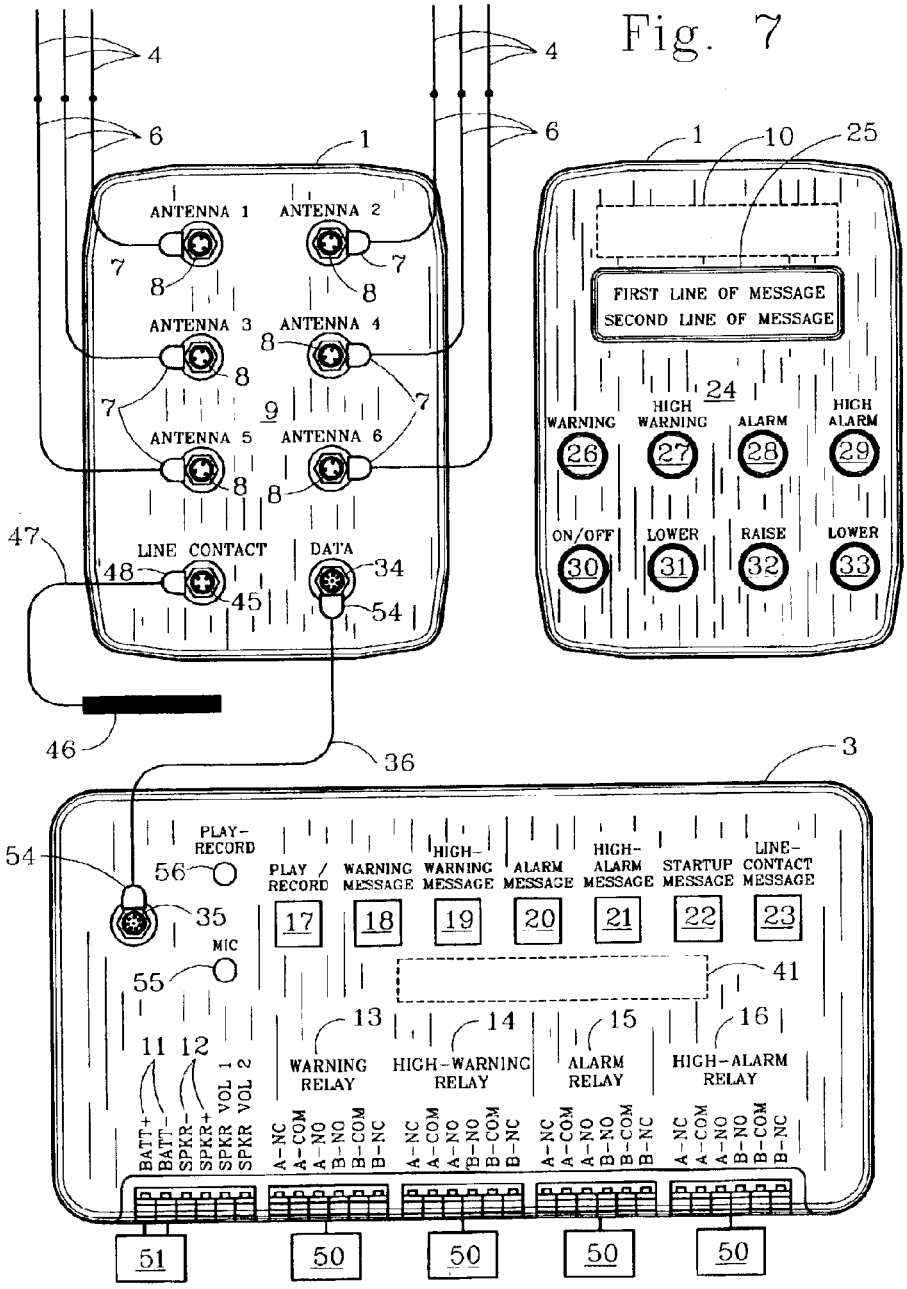
Fig. 7
ANTENNA 1
ANTENNA 2
ANTENNA 3
ANTENNA 4
ANTENNA 5
ANTENNA 6
LINE CONTACT
DATA
FIRST LINE OF MESSAGE
SECOND LINE OF MESSAGE
WARNING
HIGH WARNING
ALARM
HIGH ALARM
ON/OFF
LOWER
RAISE
LOWER
PLAY-RECORD
MIC
PLAY / RECORD
WARNING MESSAGE
HIGH-WARNING MESSAGE
ALARM MESSAGE
HIGH-ALARM MESSAGE
STARTUP MESSAGE
LINE-CONTACT MESSAGE
WARNING RELAY
HIGH-WARNING RELAY
ALARM RELAY
HIGH-ALARM RELAY
BATT+
BATT-
SPKR-
SPKR+
SPKR VOL 1
SPKR VOL 2
A-NC
A-COM
A-NO
B-NO
B-COM
B-NC

FIG. 13

SIGNAL LEVEL 35
ALARM SETPOINT 65

FIG. 14

ANTENNA FAULT
STATUS 11110111

FIG. 15

REMOTE PANEL
COMM FAULT

FIG. 16

ANTENNA STATUS
TEST - OK

FIG. 17

ANTENNA FAULT
STATUS 11111110

FIG. 18

MAXIMUM ALARM
SETPOINT = 80

FIG. 19

WAKEUP ON
WARNING LIGHT

FIG. 20

WAKEUP ON HIGH-
WARNING LIGHT

FIG. 21

WAKEUP ON
ALARM LIGHT

FIG. 22

WAKEUP ON HIGH-
ALARM LIGHT

FIG. 23

WAKEUP
DISABLED

FIG. 24

HIGH-ALARM
LIGHT SPAN = 10

FIG. 25

HIGH-WARNING
LIGHT SPAN = 10

FIG. 26

WARNING
LIGHT SPAN = 10

FIG. 27

LOW-WARNING MSG
ENABLED

FIG. 28

LOW-WARNING MSG
DISABLED

FIG. 29

HIGH-WARNING MSG
ENABLED

FIG. 30

HIGH-WARNING MSG
DISABLED

FIG. 31

ALARM MSG
ENABLED

FIG. 32

ALARM MSG
DISABLED

FIG. 33

HIGH-ALARM MSG
ENABLED

FIG. 34

HIGH-ALARM MSG
DISABLED

FIG. 35

STARTUP MESSAGE
ENABLED

FIG. 36

STARTUP MESSAGE
DISABLED

FIG. 37

LINE CONTACT
MSG LENGTH = 10

FIG. 38

LINE CONTACT
ALARM TYPE 1

FIG. 39

ANTENNA GAIN
LOW

FIG. 40

ANTENNA GAIN
MEDIUM

FIG. 41

ANTENNA GAIN
HIGH

FIG. 42

LINE CONTACT 12
SETPOINT 15

FIG. 43

DANGER - CONTACT
WITH HIGH VOLTAGE

HIGH VOLTAGE PROXIMITY WARNING SYSTEM AND METHOD

CROSS-REFERENCED TO RELATED APPLICATION

This application claims the benefit of U.S. Provisional Application Ser. No. 60/364,980, filed Mar. 14, 2002.

BACKGROUND OF THE INVENTION

This invention relates to warning devices for proximity of vehicles including heavy equipment, television trucks or any other vehicle that may come into contact with a high-voltage power lines for avoiding dangerous and damaging contact.

There are known sensors of proximity of vehicles to high-voltage power lines, but none with the high sensitivity and precision of detection and effective warning to equipment operators of proximity taught by this invention.

Dangerous and damaging contact of high-voltage power lines by vehicles continues to be a problem to equipment operators, to their rescuers, to affected users of electricity, to power companies, to construction companies and to other users of the vehicles.

Examples of most-closely related known but different devices are disclosed in the following patents:

| Patent No.: (U.S. unless stated otherwise) | Invertor: | Issue Date: |
|---|---|---|
| 4,675,644 | Cloutier, et al. | Jun. 23, 1987 |
| 2,730,245 | Auld | Jan. 10, 1956 |
| 3,125,751 | Winters | Mar. 17, 1964 |
| 3,786,468 | Moffitt | Jan. 15, 1974 |
| 3,833,898 | Wilkinson | Sep. 3, 1974 |
| 4,064,997 | Holland, et al. | Dec. 27, 1977 |
| 4,408,195 | Tullis, et al. | Oct. 4, 1983 |
| AU 261,364 | Winters, et al. | Oct. 8, 1964 |
| CA 758,721 | Winters, et al. | May 9, 1967 |
| CA 963,553 | Jepperson, et al | Feb. 23, 1975 |

SUMMARY OF THE INVENTION

Objects of patentable novelty and utility taught by this invention are to provide a high-voltage proximity warning system and method which:

- employs an analog, fourth-root function of the received electrical field signal which provides the operator with a more natural and meaningful signal level indication;
- provides sufficiently accurate detection and communication of nearness of high-voltage lines to allow heavy equipment and vehicles to work closer to them than previously without dangerous and damaging contact;
- avoids electrical field shadowing by effective positioning of a plurality of proximity antennas;
- is user adjustable to long-distance and closeness sensing of high-voltage lines;
- has effective warning communication of high-voltage line nearness to heavy equipment and vehicle operators under all operating conditions;
- warns rescuers and nearby personnel of electrically charged vehicles or heavy equipment; and
- can be adjusted to warn remote individuals and rescuers of high-voltage line nearness and electrical contact with heavy equipment or vehicles.

This invention accomplishes these and other objectives with a high-voltage proximity warning system having a local panel for being positioned in or about a cab of heavy equipment or vehicle, a remote panel in predetermined electrical communication with the local panel and one or more proximity antennas for being positioned selectively on the heavy equipment or vehicle in predetermined electrical communication with the local panel. The local panel is adapted to be push-button operable conveniently by an operator with gloved hands in a cab position where it is readily visible and easily connectable electrically to the remote panel and to the one or more proximity antennas. The remote panel is adapted to be positioned in the vicinity of the local panel where it can be protected for supportive operation and accessed for plural electrical connection to electrical devices that can include a power source, speakers, warning devices and alarm devices. The top side of the local panel includes a display screen, a warning light, a high-warning light, an alarm light, a high-alarm-light and four pushbuttons. The bottom side of the local panel includes antenna terminals, a line-contact terminal and a data terminal. The remote panel includes a data terminal for connection of the data terminal of the local panel, battery connections and speaker connections. Pluralities of warning relays, high-warning relays, alarm relays, high-alarm relays and play/record pushbuttons for each of the warnings, alarms and voice messages. A method for use includes basically configuring the operating parameters by the user technician and adjusting the alarm setpoint by the equipment operator.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are explained briefly as follows:

FIG. 6 is a top plan view of the system in the configuration mode;

FIG. 7 is a top plan view of the system in operational mode;

FIGS. 13–43 are illustrations of optional display-screen messages for configuration and operation modes;

DESCRIPTION OF PREFERRED EMBODIMENT

Listed numerically below with reference to the drawings are terms used to describe features of this invention. These terms and numbers assigned to them designate the same features throughout this description.

| | |
|---|---|
| 1. | Local panel |
| 2. | Cab |
| 3. | Remote panel |
| 4. | Proximity antenna |
| 5. | Heavy equipment |
| 6. | Shielded two-conductor cable |
| 7. | Antenna plug |
| 8. | Antenna jack |
| 9. | Local panel underside |
| 10. | Local system computer |
| 11. | Electrical-source terminal |
| 12. | Speaker terminal |
| 13. | Warning relay |
| 14. | High-warning relay |
| 15. | Alarm relay |
| 16. | High-alarm relay |
| 17. | Play/record pushbutton |
| 18. | Warning-message test pushbutton |
| 19. | High-warning-message test pushbutton |
| 20. | Alarm-message test pushbutton |
| 21. | High-alarm-message test pushbutton |
| 22. | Startup-message test pushbutton |
| 23. | Line-contact-message test pushbutton |
| 24. | Local panel topside |
| 25. | Display screen |
| 26. | Warning light |
| 27. | High-warning light |
| 28. | Alarm light |
| 29. | High-alarm-light |
| 30. | Power pushbutton |
| 31. | Lower pushbutton |
| 32. | Raise pushbutton |
| 33. | Test pushbutton |
| 34. | Local data jack |
| 35. | Remote data jack |
| 36. | Data cable |
| 37. | Configuration cable |
| 38. | Local data plug |
| 39. | Adapter plug |
| 40. | High-voltage lines |
| 41. | Remote system computer |
| 42. | Two-conductor cable |
| 43. | Line-contact antenna |
| 44. | Three-conductor pins |
| 45. | Line-contact antenna jack |
| 46. | Line-contact sensor |
| 47. | Shielded four-conductor cable |
| 48. | Four-conductor plug |
| 49. | Four-conductor pins |
| 50. | Communication devices |
| 51. | Ignition terminal |
| 52. | Bracket |
| 53. | Knob |
| 54. | Eight-pin female plug |
| 55. | Microphone jack |
| 56. | Play/Record light |
| 57. | O-Ring |
| 58. | Copper tubing |
| 59. | Plastic pipe |
| 60. | Rubber sealant |
| 61. | Washer |

Figure 44:
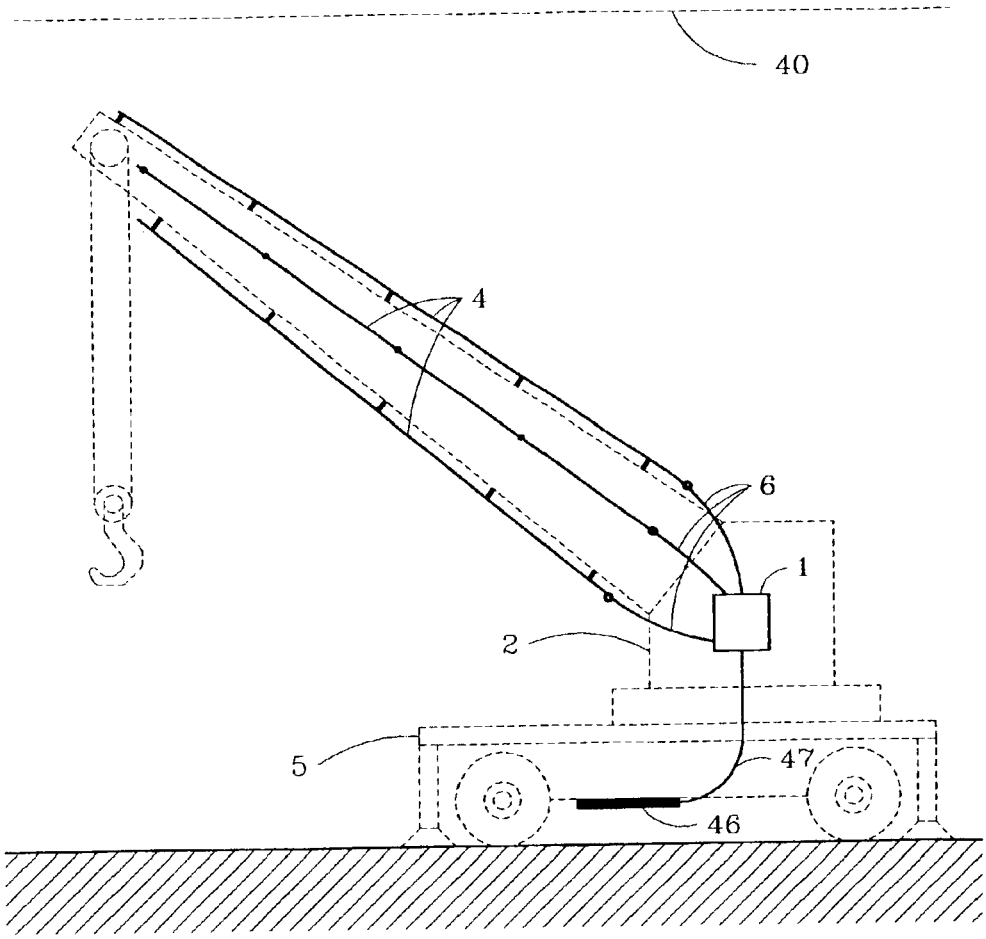
FIG. 44 is a dashed-line illustration of representative heavy equipment for operation in relation to overhead high-voltage power lines.

Referring to FIGS. 1–8 and 44, a high voltage proximity warning system has a local panel 1, shown in FIGS. 1–3 and 6–7, adapted for being positioned in predeterminedly operational, audio and visual nearness to a heavy-equipment or vehicle operator in or about the heavy-equipment or vehicle cab 2, shown in FIG. 44.

Figure 1:
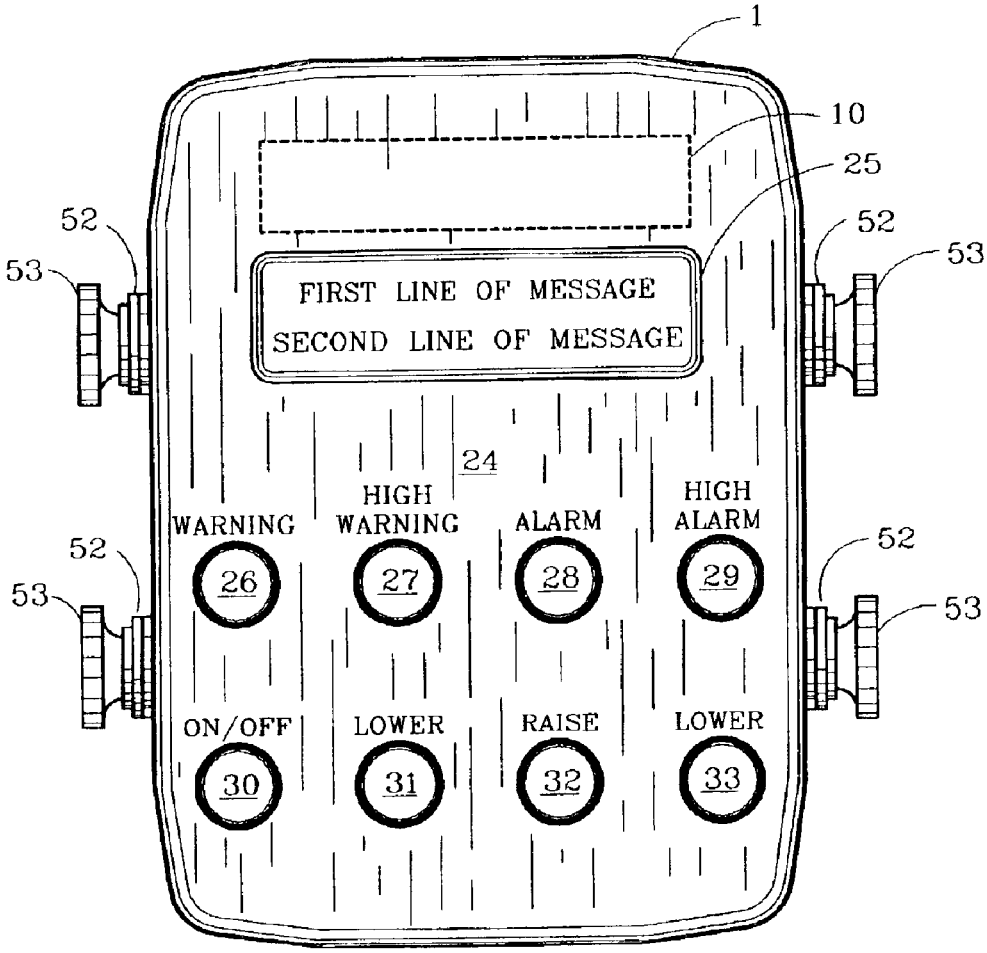
FIG. 1 is a topside view of the local panel.
Figure 2:
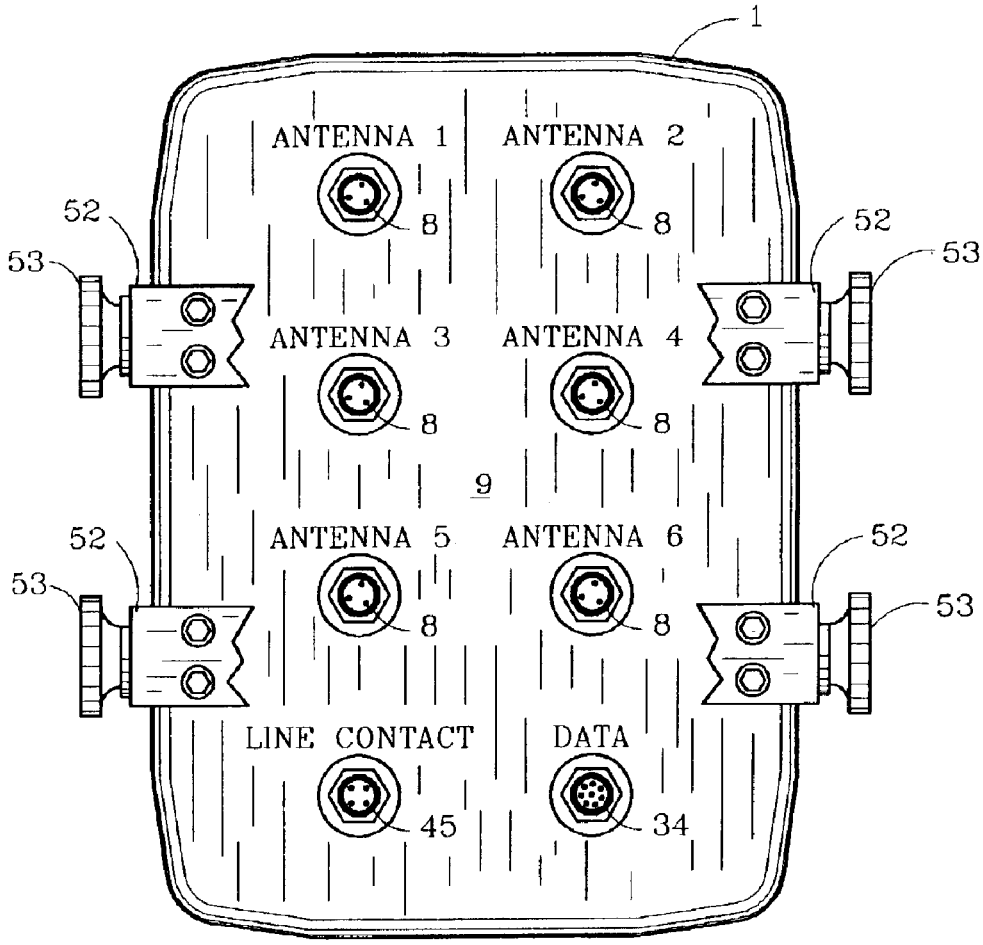
FIG. 2 is a partially cutaway underside view of the local panel.
Figure 3:
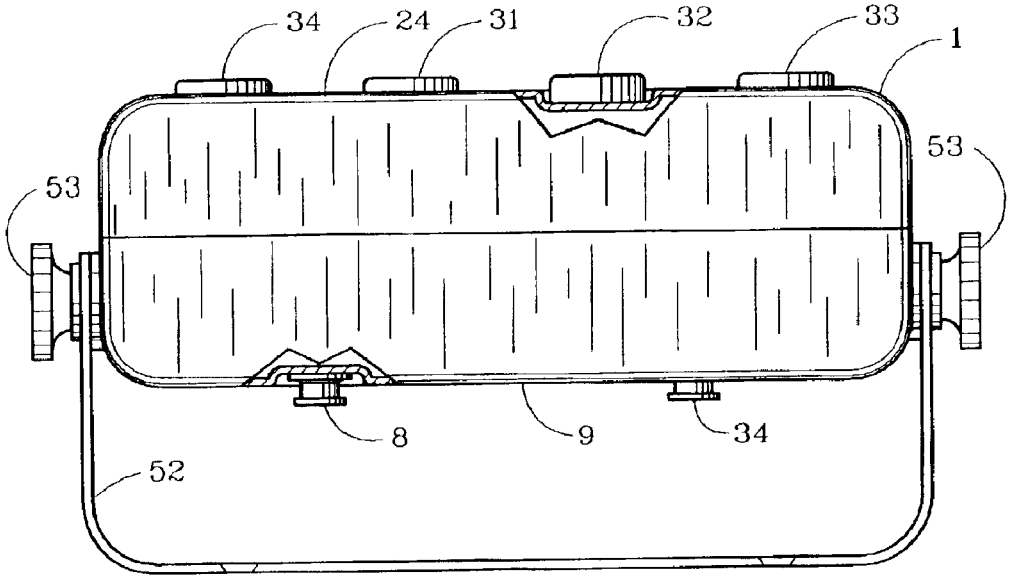
FIG. 3 is a partially cutaway end view of the local panel.
Figure 4:
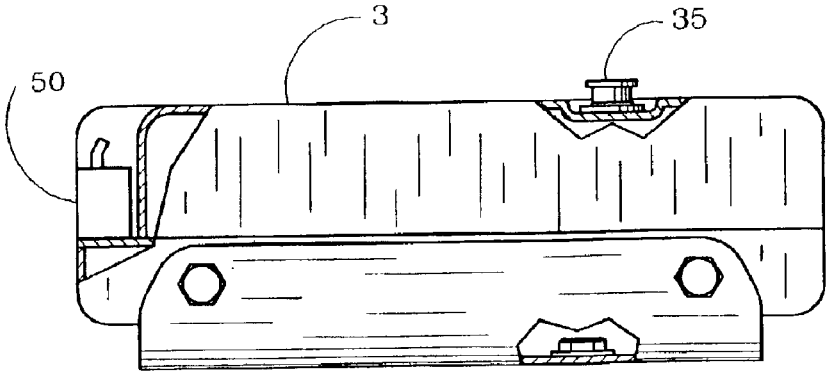
FIG. 4 is a partially cutaway end view of the remote panel.
Figure 5:
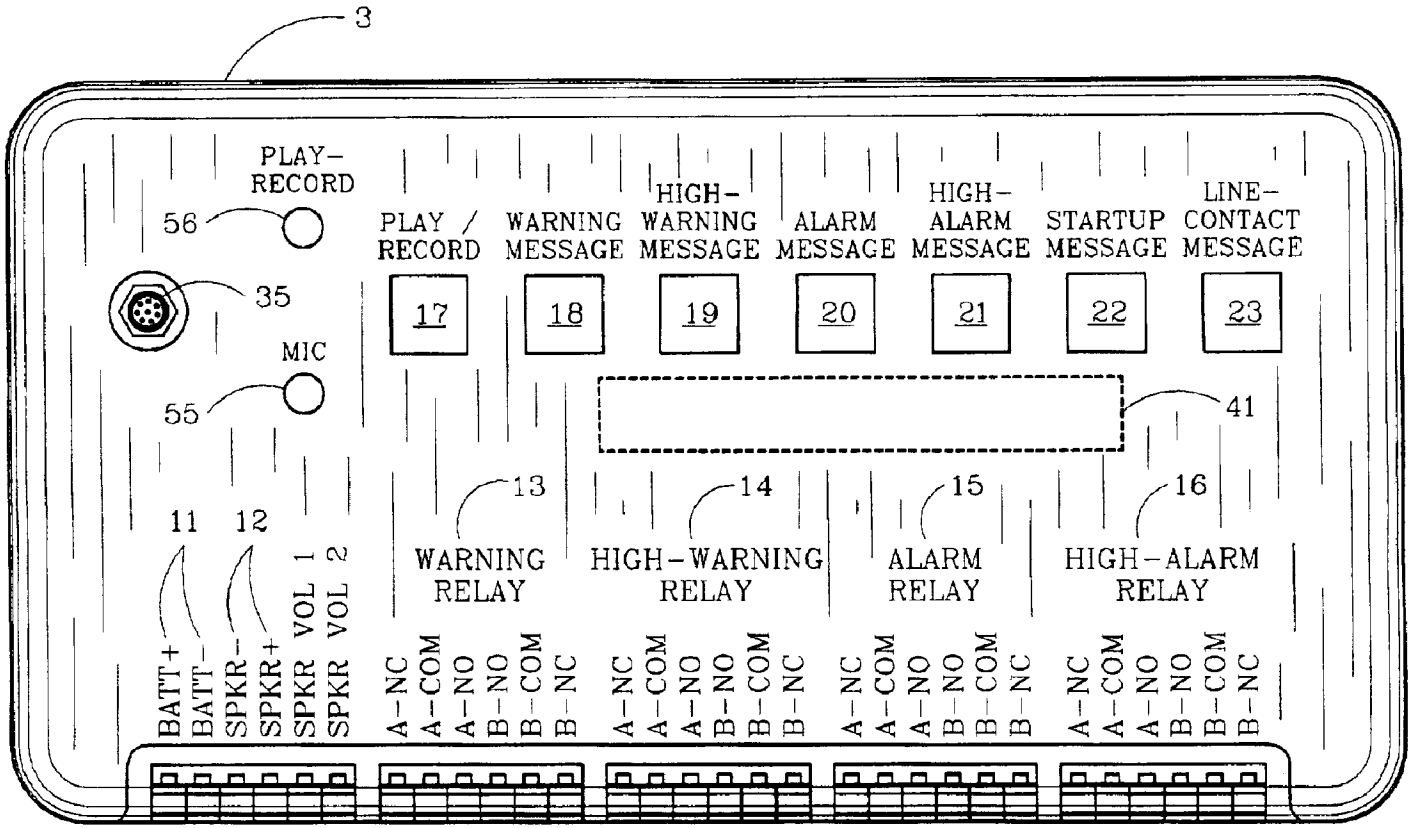
FIG. 5 is a top plan view of the remote panel.
Figure 8:
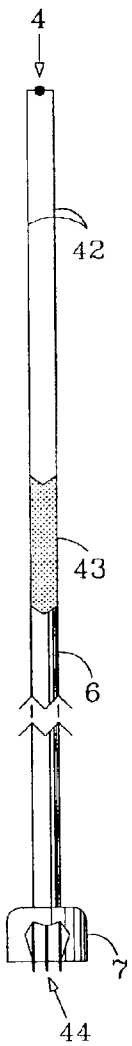
FIG. 8 is a partially cutaway side elevation view of a proximity antenna.
Figure 9:
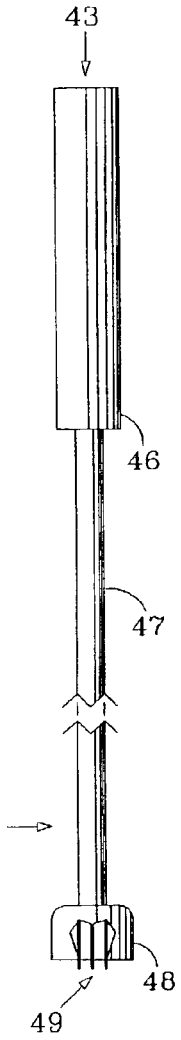
FIG. 9 is a partially cutaway side elevation view of a line-contact sensor.

A remote panel 3 is adapted for being positioned in predeterminedly operational, audio and visual remoteness from the local panel 1. Up to six electrical-field-sensing proximity antennas 4, as shown in FIGS. 6–8, are adapted for being positioned selectively on heavy-equipment 5 or a vehicle on which the heavy-equipment or vehicle cab 2 is positioned.

The one or more electrical-field-sensing proximity antennas 4 have shielded antenna cables 6 with antenna plugs 7 that are connectable to antenna jacks 8 on a local panel underside 9 of the local panel 1 for being in predetermined electrical communication with a local system computer 10 in the local panel 1.

The remote panel 3 has a plurality of electrical terminals which include a double-poled electrical-source terminal 11. The remote panel 3 has a plurality of remote data terminals which include one or more speaker terminals 12, one or more warning relays 13, one or more high-warning relays 14, one or more alarm relays 15, one or more high-alarm relays 16, a play/record light 56, a microphone jack 55, a play/record pushbutton 17, a warning-message test pushbutton 18, a high-warning-message test pushbutton 19, an alarm-message test pushbutton 20, a high-alarm-message test pushbutton 21, a startup-message test pushbutton 22, and a line-contact-message test pushbutton 23 in predetermined electrical communication with the remote system computer 41.

A local panel topside 24 of the local panel 1 has a plurality of local data transmitters which include a display screen 25, a warning light 26, a high-warning light 27, an alarm light 28, a high-alarm-light 29, an on/off power pushbutton 30, a lower pushbutton 31, a raise pushbutton 32 and a test pushbutton 33 in predetermined communication with the local system computer 10.

The local panel 1 has a local data jack 34 on the local panel underside 9 in predetermined electrical communication with the local system computer 10. The remote panel has a remote data jack 35 in predetermined electrical communication with the remote system computer 41. A data cable 36 is adapted for conveyance of electrical power current from the remote panel 3 to the local panel 1, and for electrical data communication intermediate the local data-jack 34 and the remote data jack 35.

The local system computer 10 is adapted and positioned to receive, to computer-process and to communicate high-voltage sensing data from the proximity antennas 4 for communication to and for relay by communication and warning devices through the display screen 25, through the local data transmitters, to the remote system computer 41. The remote system computer 41 is adapted and positioned to receive, to computer-process and to communicate data to the remote data terminals and to the local panel 1 predeterminedly. The local system computer 10 has a configuration mode with a configuration menu for configuring the local system computer 10 and the remote system computer 41 with features of items of the configuration menu.

The configuration menu is adapted for being accessible with a configuration cable 37 having a local data plug 38 in communication with the local data jack 34 and having an adapter plug 39 in communication with a first end of the data cable 36 that has a second end in communication with the remote data jack 35, as shown in FIGS. 6 and 10–12.

The plurality of up to six proximity antennas 4 are positioned on portions of the heavy equipment 5 or vehicle devices for avoiding shadowing of directional electrical-field sensing from high voltage lines 40 by the proximity antennas 4, as depicted in FIG. 44, such that all directions from the heavy-equipment 5 or other vehicle devices are exposed to electrical-field sensing by the proximity antennas 4. No particular positioning is illustrated because it can differ for the different heavy-equipment 5 or other vehicle devices. The heavy-equipment 5 shown in dashed lines is representative of typical operation.

The electrical communication of the proximity antennas 4 with the local panel 1 includes communication of a predeterminedly low-voltage of electricity from the local panel 1 to the proximity antennas 4 for creating a testing circuit of electricity intermediate all portions of the proximity antennas 4 and the local panel 1 predeterminedly. A low-voltage functional testing current is maintained intermediate an antenna display status to the display screen 25 and all portions of the proximity antennas 4 and line-contact antenna 43.

As shown in FIG. 8, the plurality of up to six of the proximity antennas 4 each includes an active portion two-conductor cable 42, an inactive portion shielded two-conductor cable 6, and an antenna plug 7. The active portion two-conductor cable 42 is the electrical-field-sensing portion of the proximity antenna 4 which includes a two-conductor cable 42 whose conductors are connected at the distal ends of each of the proximity antennas 4. This configuration provides an electrical current path for a low-voltage antenna testing current. The electric field of the high-voltage lines 40 capacitively couples a signal voltage from the high-voltage lines 40 to the active two-conductor cable 42, and to the inactive portion shielded two-conductor cable 6. The shielded two-conductor cable 6 is terminated with the antenna plug 7 which includes three-conductor pins 44, two of which are connected to the conductors of the proximity antenna 4 and one of which is connected to the shield of the shielded two-conductor cable 6. The received signal is processed by analog circuitry and the local system computer 10 and is displayed on the display screen 25 of the local panel 1.

A predeterminedly small DC electrical current for checking electrical continuity of the proximity antenna 4 against short-circuits, open circuits or electrical grounding is communicated to the local panel 1 continuously.

As depicted in FIGS. 2, 6–7 and 9, the local panel underside 9 of the local panel 1 includes a sensor jack 45 having a separate dedicated circuit to a line-contact sensor 46 located on a protected underside of heavy-equipment 5 or other vehicle, which is shown in FIG. 44, for separately sensing and communicating to the local system computer 10, the existence of a high-voltage electric potential on the heavy-equipment 5 or vehicle relative to the potential of the ground immediately below the heavy-equipment 5 or vehicle. The line-contact antenna 43 includes a line-contact sensor 46, a shielded four-conductor cable 47 and a four-conductor plug 48. The line-contact sensor 46 consists of a specially constructed antenna which is connected to two of the four connectors in the shielded four-conductor cable 47. This configuration provides an electrical current path for a low-voltage antenna testing current. If the heavy-equipment 5 or vehicle should come into contact with a high-voltage line, a potential voltage will exist between the heavy-equipment 5 or vehicle and the ground immediately below the heavy-equipment 5 or vehicle. This potential creates an electrical field that capacitively couples a signal voltage to the line-contact sensor 46, which is connected to two-conductors of the shielded four-conductor 47. The received signal is processed by analog circuitry and the local system computer 10 to provide an alarm sequence consisting of a line-contact alarm, a line-contact voice message, a line-contact display alarm as depicted in FIG. 43 on the display screen 25, warning light 26 blinking, high-warning light 27 blinking, alarm light 28 blinking and the high-alarm-light 29 blinking. While the line-contact alarm is in effect, the warning relay 13, the high-warning relay 14, the alarm relay 15 and the high-alarm relay 16 are all de-energized.

Figure 45:
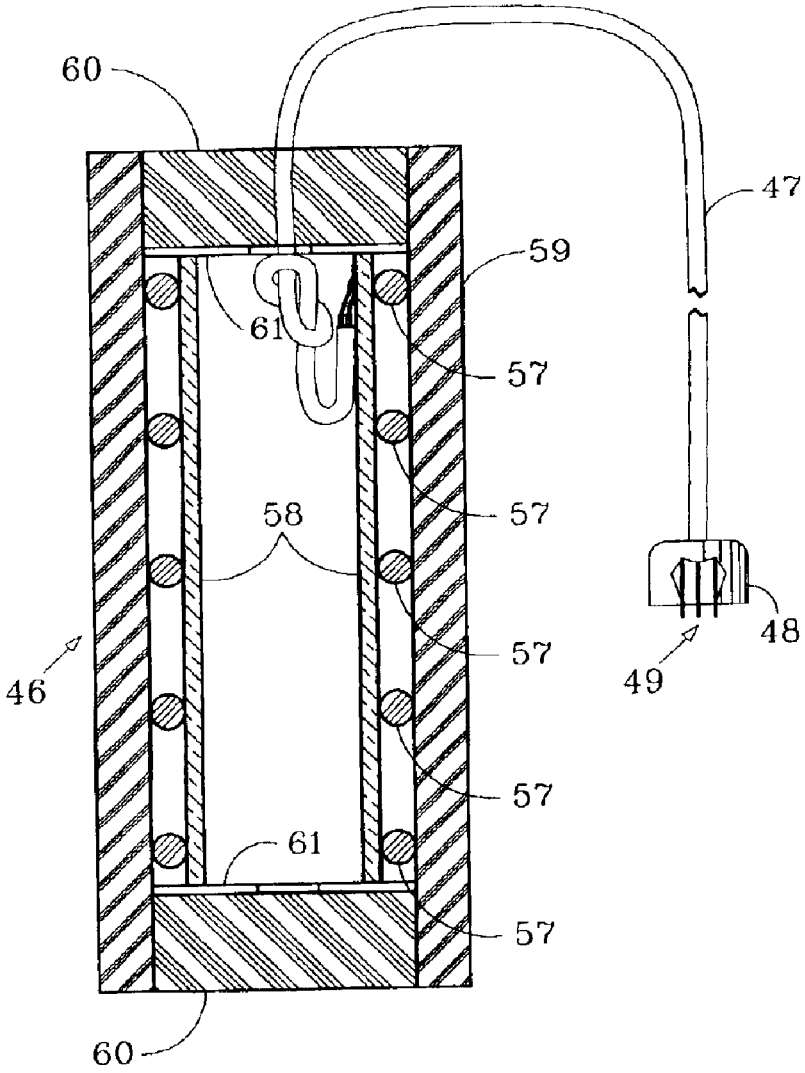
FIG. 45 is a cutaway view of the line-contact antenna.

As depicted in FIG. 45, the line-contact sensor includes a section of copper tubing 58 that is centered in a section of plastic pipe 59 by a series of o-rings 57. The first two conductors of the shielded four-conductor wire 47 is soldered to the inside of the section of copper tubing 58. The tubing is centered and secured in the center of section of plastic pipe by two washers 61. The entire line-contact sensor 46 is sealed at both ends with a rubber sealant 60.

The proximity antenna circuitry senses the voltage difference between the voltage induced into the proximity antenna 4 and the voltage induced into the heavy-equipment 5 or vehicle. The heavy-equipment 5 or vehicle may or may not be at ground potential. The line-contact circuitry includes a correction signal to the proximity antenna circuitry in the event that an ungrounded or partially ungrounded heavy-equipment 5 or vehicle comes into close proximity to high-voltage lines 40 thereby inducing a voltage into the heavy-equipment 5 or vehicle resulting in a lower voltage differential between the proximity antenna 4 and the heavy-equipment 5 or vehicle and the earth directly beneath the vehicle and provides the correction signal to the proximity antenna circuitry thereby eliminating the signal level error that would result from using an ungrounded or partially ungrounded heavy-equipment 5 or vehicle.

A predeterminedly small DC current for continuously checking electrical continuity of two of the conductors of the shielded four-conductor cable 47 to the line-contact sensor 46 against short-circuits, open circuits or grounding is communicated to the local panel 1 continuously. A third one of the four-conductor pins 49 is connected to the shield of the shielded four-conductor cable 47. A fourth of the four-conductor pins 49 is reserved for optional use.

As depicted in FIGS. 1, 6–7 and 13–43, the display screen on the local panel 1 includes a first line of information and a second line of information. The first line of information includes a display of the signal level value indication of the highest weighted signal level that is sensed on all of the proximity antennas 4. The signal level value indication ranges from one-to-ninety-nine and employs an analog, fourth-root function of the received electrical field signal which provides the operator with a more natural and meaningful signal level indication. The second line of information includes a display of a setting of the alarm setpoint that can be adjusted by the heavy-equipment or vehicle operator with the raise pushbutton 32 or the lower pushbutton 31.

The local system computer 10 is adapted for the display screen 25 to display a warning-message to the heavy-equipment 5 or vehicle operator in the event a failure or fault of a proximity antenna 4 or line-contact antenna 43. The warning-message includes identity of any one or more faulted proximity antennas 4 or line-contact antenna 43 as shown in FIG. 14. The local system computer 10 is adapted to alternate the antenna fault status message FIG. 14 on the display screen 25 with the normal display shown in FIG. 13 while the antenna failure or fault is in effect.

The local system computer 10 is adapted is adapted for the display screen 25 to display a warning-message to the heavy-equipment 5 or vehicle operator in the event of failure of communication between the local panel 1 and the remote panel 3. The local system computer 10 is adapted to alternate the remote panel communication fault message FIG. 15 on the display screen 25 with the normal display shown in FIG. 13 while the communication failure or fault is in effect.

The alarm light 28 on the local panel 1 is adapted to be factory set with the local system computer 10 for actuation at a proximity-antenna closeness to high-voltage lines 40 that will result in a signal level indication that is equal or greater than the alarm setpoint as shown on the display screen 25 as depicted in FIG. 13. The range within which the alarm setpoint can be set by the heavy-equipment operator or vehicle operator is adapted to be set by the user technician while in the configuration mode. The alarm setpoint is adapted to be adjustable by the heavy-equipment operator or vehicle operator between a minimum value of ten signal units and a maximum value of the maximum alarm setpoint such that the heavy equipment or vehicle operator is prevented from inadvertently setting the alarm setpoint at a dangerously high level. The maximum alarm setpoint is programmable from forty-to-eighty signal units by the user technician with the local system computer 10 in the configuration mode.

Communication from the local system computer 10 for actuation of the alarm light 28 includes predetermined communication to the remote system computer 41 and subsequently to additional alarm and communication devices 50. Included in the communication devices is a factory default alarm voice message and a factory default alarm beep pattern that consists of three short, high-frequency beeps that is actuated whenever the signal level indication on the display screen 25 is greater than the alarm setpoint and is lower than the high-alarm setpoint and a line-contact alarm condition is not actuated. The alarm voice message is alternated with the alarm beep pattern while the alarm is actuated. The user technician can disable or change the content of the alarm voice message with the local system computer 10 in the configuration mode. While an alarm condition is actuated and the alarm voice message is disabled, the alarm beep pattern continues until the signal level decreases below the alarm setpoint or the signal level increases above the high-alarm setpoint and a line-contact alarm condition is not actuated. The warning light 26, the high-warning light 27 and the alarm light 28 are lit while an alarm condition is actuated and a line-contact alarm condition is not actuated.

The local system computer 10 is programmed for the high-alarm-light 29 to be actuated by actuation of the alarm light 28 followed by continued approach towards high-voltage lines 40. The factory default setting for actuation of the high-alarm-light is ten signal units greater than the alarm setpoint. The value of the high-alarm-light setpoint is adjustable from four-to-twenty signal units above the alarm light setpoint by the user technician with the local system computer 10 in the configuration mode.

Communication from the local system computer 10 for actuation of the high-alarm-light 29 includes predetermined communication to the remote system computer 41 and subsequently to the additional high-alarm and communication devices 50. Included in the optional communication is a factory default high-alarm voice message and a factory default high-alarm beep pattern that consists of four very short, very high-frequency beeps that is actuated whenever the signal level indication on the display screen 25 is greater than the high-alarm setpoint. The high-alarm voice message is alternated with the high-alarm beep pattern while the high-alarm is actuated. The user technician can disable or change the content of the high-alarm voice message with the local system computer 10 in the configuration mode. While the high-alarm condition is actuated and the high-alarm voice message is disabled, the high-alarm beep pattern continues until the signal level decreases below the high-alarm setpoint and a line-contact alarm condition is not actuated. The warning light 26, the high-warning light 27, the alarm light 28 and the high-alarm-light 29 are lit while a high-alarm condition is actuated and a line-contact alarm condition is not actuated.

The local system computer 10 is programmed for the high-warning light 27 to be actuated by actuation of the warning light 26, followed by continued approach towards high-voltage lines 40. The factory default setting for actuation of the high-warning light 27 is ten signal units below the alarm setpoint. The value of the high-warning light setpoint is adjustable from four-to twenty signal units below the alarm light setpoint by the user technician with the local system computer 10 in the configuration mode.

Communication from the local system computer 10 for actuation of the high-warning light 27 includes predetermined communication to the remote system computer 41 and subsequently to the additional high-warning and communication devices 50. Included in the communication devices is a factory default high-warning voice message and a factory default high-warning beep pattern that consists of two long, low-frequency beeps that is actuated whenever the signal level indication on the display screen 25 is greater than the high-warning setpoint and is lower than the alarm setpoint and a line-contact alarm condition is not actuated. The high-warning voice message is alternated with the high-warning beep pattern while the high-warning is actuated. The user technician can disable or change the content of the high-warning voice message with the local system computer 10 in the configuration mode. While the high-warning condition is actuated and the high-warning voice message is disabled, the high-warning beep pattern continues until the signal level decreases below the high-warning setpoint or the signal level increases above the alarm setpoint and a line-contact alarm condition is not actuated. The warning light 26 and the high-warning light 27 are lit while a high-warning condition is actuated and a line-contact alarm condition is not actuated.

The local system computer 10 is programmed for the warning light 26 to be actuated by approach towards high-voltage lines 40. The factory default setting for actuation of the warning light 26 is ten signal units below the high-alarm setpoint. The value of the warning light setpoint is adjustable from four-to twenty signal units below the high-warning setpoint by the user technician with the local system computer 10 in the configuration mode.

Communication from the local system computer 10 for actuation of the warning light 26 includes predetermined communication to the remote system computer 41 and subsequently to the additional warning and communication devices 50. Included in the communication devices is a factory default warning voice message and a factory default warning beep pattern that consists of two very long, very low-frequency beeps that is activated whenever the signal level indication on the display screen 25 is greater than the warning setpoint but is lower than the high-warning setpoint and a line-contact alarm condition is not actuated. The warning voice message is alternated with the warning beep pattern while the warning is actuated. The user technician can disable or change the content of the warning voice message with the local system computer 10 in the configuration mode. While the warning condition is actuated and the warning voice message is disabled, the warning beep pattern continues until the signal level decreases below the warning setpoint or the signal level increases above the high-warning setpoint and a line-contact alarm condition is not actuated. The warning light 26 is lit while a warning condition is actuated and a line-contact alarm condition is not actuated.

The local system computer 10 is programmed for the line-contact alarm to be actuated whenever high-voltage lines 40 come into direct contact with heavy equipment 5 or a vehicle. A line-contact sensor 46 is fastened to the protected underside of the heavy equipment 5 or vehicle whose function is to sense the electric field as a result of a difference in electrical potential between the heavy equipment 5 or vehicle and the earth beneath the vehicle. A factory default setting for actuation of the line-contact alarm is fifteen line-contact signal units. The value of the line-contact setpoint is adjustable from one-to-forty line-contact signal units by the user technician with the local system computer 10 in the configuration mode.

Communication from the local system computer 10 for actuation of the warning light 26, the high-warning light 27, the alarm light 28 and the high-alarm-light 29 includes communication to the remote panel computer 4 and subsequently to the additional warning and communication devices 50. Included in the communication devices is a factory default line-contact alarm voice message and a factory default alarm pattern that is activated whenever the line-contact signal exceeds the line-contact alarm setpoint and is deactivated whenever the line-contact signal decreases below the line-contact alarm setpoint. While the line-contact alarm is activated, the line-contact alarm voice message is alternated with the line-contact alarm pattern and the warning light 26, the high-warning light 27, the alarm light 28 and the high-alarm-light 29 blink in a predetermined pattern. The user technician can change the content of the line-contact alarm voice message and select one of four line-contact alarm patterns with the local system computer in the configuration mode.

The local system computer 10 is programmed for a startup message to be actuated when the local panel is initially energized. The factory default setting for the actuation of the startup message is enabled. The startup message can be enabled or disabled or changed in content by the user technician with the local system computer 10 in the configuration mode. While the startup message is activated, a warning, a high-warning, an alarm, a high-alarm or a line-contact alarm will override the startup message.

The power pushbutton 30 is adapted for actuation by the heavy-equipment operator or vehicle operator for energizing the high-voltage proximity warning system through the remote panel 3 which is energized downstream electrically from a heavy-equipment ignition terminal 51 that has been turned on.

A default safety precaution is programmed into the local system computer 10 to avoid danger and damage from turning on the ignition terminal 51 and operating the heavy-equipment 5 or other vehicle without activating the power pushbutton 30. The default safety precaution includes adaptation of the local panel 1 to be energized without energizing the display screen 25 and for wakeup and alarm from occurrence of a signal level to the alarm setpoint as though the power pushbutton 30 were pressed. The local panel 1 then cannot be turned off by the power pushbutton while the alarm condition is still in effect. The default safety precaution is programmable by the user technician for wake-up whenever the signal level equals either the warning light setpoint, the high-warning light setpoint, the alarm light setpoint or the high-alarm-light setpoint. The default safety precaution is terminable by the user technician with the local system computer 10 in the configuration mode.

The lower pushbutton 31 is adapted for use by the heavy-equipment operator or vehicle operator to decrease the alarm setpoint while the local panel 1 is not in the configuration mode. The raise pushbutton 32 is adapted for use by the heavy-equipment operator or vehicle operator to increase the alarm setpoint while the local panel computer is in the normal mode. The alarm setpoint is not changed by turning the local panel 1 on or off. The minimum value of the alarm setpoint is ten signal units as displayed on the display screen 25. The maximum value of the alarm setpoint is the value of the maximum alarm setpoint set by the user technician while the local panel is in the configuration mode. The lower pushbutton 31 and raise pushbutton are adapted for use by the user technician while the local panel 1 is in the configuration mode.

The test pushbutton 33 is adapted for use by the heavy-equipment operator or vehicle operator to indicate the absence or existence of antenna faults when pressed while the local panel 1 is not in the configuration mode. Codes are provided for indicating which, if any, of the proximity antennas 4 or line-contact antenna 43 are faulted. While the local panel 1 is in the configuration mode, the test pushbutton 33 is adapted to select various configuration modes and to save the configuration settings into the memory of the local system computer 10 and remote system computer 41.

Display-screen messages for testing antenna status and remote-panel communication are shown in FIGS. 14–17.

The local panel 1 is adapted to be mounted within approximately six feet of the heavy-equipment operator or vehicle operator for providing full view of the local panel 1 and for providing immediately convenient access to control pushbuttons. The local panel 1 includes two brackets 52 having attachment-fastener knobs 53 for secure mounting in any foreseeable geometry on or about a heavy-equipment cab 2 or vehicle. The brackets 52 are adapted for elevation of the local panel underside of the local panel 1 for ease of attaching proximity antennas 4, line-contact antenna 43, data cable 36 and configuration cable 37 where it will not obstruct the activities of the heavy-equipment operator or vehicle operator. The local panel 1 is adapted for protection against the elements, for rugged use and for harsh environments with connections to the local panel 1 being watertight. Additional protection can be provided for environments that include highly conductive contaminants, such as coal dust, by applying silicon grease or its equivalent to the mating parts of the cable connectors and plugs.

Figure 10:
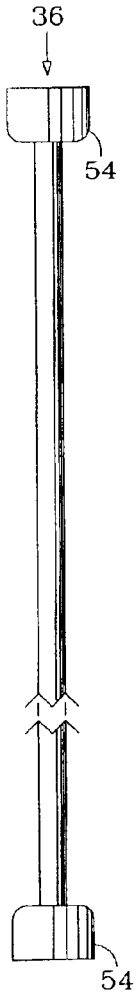
FIG. 10 is a partially cutaway side elevation view of a data cable.
Figure 11:
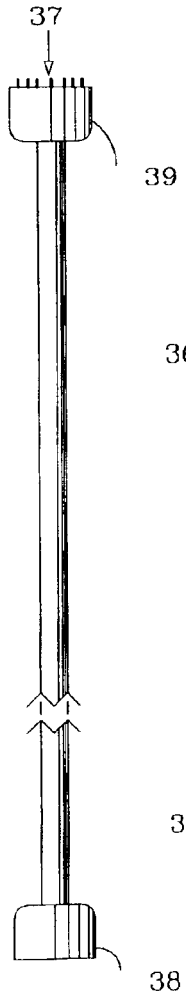
FIG. 11 is a partially cutaway side elevation view of a configuration cable.
Figure 12:
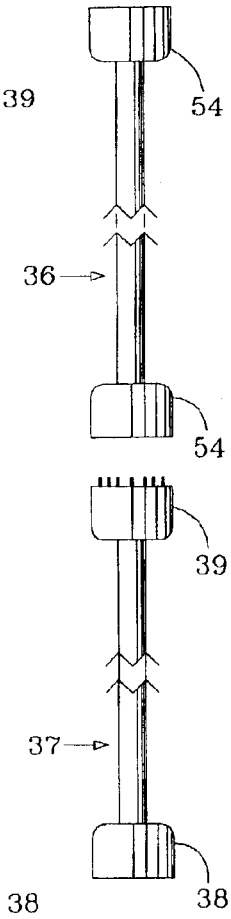
FIG. 12 is a partially cutaway side elevation view of a configuration cable positioned for connection to the data cable for accessing a configuration mode of the local system computer.

As shown in FIG. 10, the data cable 36 has an two eight-pin female plugs 54 that are adapted for a first data-cable plug to be plugged into a remote panel jack 35 on the remote panel 3 and a second data-cable plug to be plugged into a local data jack 34 on the local panel underside 9 of the local panel 1.

The remote panel 3 is shown in FIGS. 4-7 is adapted for being mounted in proximity to the local panel 1 in a less harsh environment than for the local panel 1. The remote panel 3 is adapted for a plurality of electrical connections in a predeterminedly protected environment which includes an appropriate enclosure.

The configuration menu of the local system computer 10 is accessible by the user technician and is adapted for being accessible by pushing the power pushbutton 30 after placing the configuration cable 37 having the local data plug 38 in communication with the local data jack 34 and having the adapter plug 39 in communication with a second end of the data cable 36 that has a first end in communication with the remote data jack 35.

The configuration menu includes a plurality of configuration items. The configuration items are accessed sequentially by pressing the test pushbutton 33; this action also saves the value of the previously displayed configuration into the memories of the local system computer 10 and the remote system computer 41. While in the configuration mode, if the power is removed by any means, the value of the current configuration item shown on the display screen 25 is not saved into, the memories of the local system computer 10 or the remote system computer 41. The configuration items include selections that are adjustable by pressing the raise pushbutton 32 and the lower pushbutton 31.

The plurality of configuration items of the configuration menu includes a maximum alarm setpoint. The maximum alarm setpoint is adjustable between a minimum value of forty signal units and a maximum value of eighty signal units. This allows the heavy-equipment operator or vehicle operator to adjust the alarm setpoint on the display screen 25 between a low value of ten and a high value of the maximum alarm setpoint.

The plurality of configuration items of the configuration menu includes a panel wake-up that is adapted to activate the high-voltage proximity warning system without pushing the power pushbutton 30 in the event that the heavy equipment 5 or vehicle comes into sufficient proximity of high-voltage lines 40 such that the resulting signal level would equal or exceed the warning light setpoint. The panel wake-up is adapted for five user technician options of wake-up modes which include:

- wakeup for warning light 26 actuation and warning actions whenever the signal level exceeds the warning light 26 setpoint;
- wakeup for high-warning light 27 actuation and high-warning actions whenever the signal level exceeds the high-warning light 27 setpoint;
- wakeup for alarm light 28 actuation and alarm actions whenever the signal level exceeds the alarm light 28 setpoint;
- wakeup for high-alarm-light 29 actuation and alarm actions whenever the signal level exceeds the high-alarm-light 29 setpoint; and
- wakeup mode disabled for totally disabling the panel wakeup.

The raise pushbutton 32 is adapted to be pressed for scrolling upwardly through the wakeup modes which appear on the display screen 25. The lower pushbutton 31 is adapted to be pressed for scrolling downwardly through the wakeup modes which appear on the display screen 25. The selected wakeup mode is set by pressing the test pushbutton 33. Pressing the test pushbutton 33 saves the wakeup mode into the memory of the local system computer 10 and scrolls the configuration menu to the warning-light span adjustment mode. Display-screen wakeup selections are shown in FIGS. 19–23.

The plurality of configuration items of the configuration menu includes the warning-light span. The warning-light span is the signal level difference between the warning-light setpoint and the high-warning-light setpoint. The factory default setting of the warning-light span is ten signal units.

The local computer system 10 is adapted for user technician configurational adjustment of the warning-light span between a minimum value of four signal units to a maximum value of twenty signal units. FIG. 26 appears on the display screen 25 during the warning-light span adjustment. The raise pushbutton 32 is adapted to be pressed to raise the warning-light span to a maximum value of twenty signal units while the lower pushbutton 31 is adapted to be pressed to lower the warning-light span to a minimum value of four signal units. Pressing the test pushbutton 33 saves the warning-light span value into the memory of the local system computer 10 and scrolls the configuration menu into the high-warning-light span adjustment mode.

The plurality of configuration items of the configuration menu includes the high-warning-light span. The high-warning-light span is the signal level difference between the high-warning-light setpoint and the alarm setpoint. The factory default setting of the high-warning-light setpoint is ten signal units. The local system computer 10 is adapted for user technician configurational adjustment of the high-warning-light span between a minimum value of four signal units to a maximum value of twenty signal units. FIG. 25 appears on the display screen 25 during the high-warning-light span adjustment. The raise pushbutton 32 is adapted to be pressed to raise the high-warning-light span to a maximum value of twenty signal units while the lower pushbutton 31 is adapted to be pressed to lower the high-warning-light span to a minimum value of four signal units. Pressing the test pushbutton 33 saves the high-warning-light span value into the memory of the local system computer 10 and scrolls the configuration menu into the high-alarm-light span adjustment mode.

The plurality of configuration items of the configuration menu includes the high-alarm-light span. The high-alarm-light span is the signal level difference between the alarm setpoint and the high-alarm-light setpoint. The factory default setting of the high-alarm-light setpoint is ten signal units. The local system computer 10 is adapted for user technician configurational adjustment of the high-alarm-light span between a minimum value of four signal units to a maximum value of twenty signal units. FIG. 25 appears on the display screen 25 during the high-alarm-light span adjustment. The raise pushbutton 32 is adapted to be pressed to raise the high-alarm-light span to a maximum value of twenty signal units while the lower pushbutton 31 is adapted to be pressed to lower the high-alarm-light span to a minimum value of four signal units. Pressing the test pushbutton 33 saves the high-alarm-light span value into the memory of the local system computer 10 and scrolls the configuration menu into the warning-message enable-disable selection mode.

The plurality of configuration items of the configuration menu includes the warning-message enable/disable adjustment mode. The warning-message is a factory default voice message that follows a warning consisting of one very long, very low frequency beep pattern that is activated whenever the signal level indication on the display screen is greater than the warning setpoint but is lower than the high-warning setpoint. The factory default configuration setting of the warning-message enable/disable mode is enabled. FIG. 27 appears on the display screen 25 if the warning-message is enabled and FIG. 28 appears on the display screen 25 if the warning-message is disabled. The raise pushbutton 32 is adapted to be pressed to enable the warning-message while the lower pushbutton 31 is adapted to be pressed to disable the warning-message. Pressing the test pushbutton 33 saves the warning-message enable/disable setting into the memory of the local system computer 10 and scrolls to the configuration menu for the high-warning-message enable/disable selection mode.

The plurality of configuration items of the configuration menu includes the high-warning-message enable/disable adjustment mode. The high-warning-message is a factory default voice message that follows a high-warning consisting of two long, low frequency beep pattern that is activated whenever the signal level indication on the display screen is greater than the high-warning setpoint but is lower than the alarm setpoint. The factory default configuration setting of the high-warning-message enable/disable mode is enabled. FIG. 29 appears on the display screen 25 if the high-warning-message is enabled and FIG. 30 appears on the display screen 25 if the high-warning-message is disabled. The raise pushbutton 32 is adapted to be pressed to enable the high-warning-message while the lower pushbutton 31 is adapted to be pressed to disable the high-warning-message. Pressing the test pushbutton 33 saves the high-warning-message enable/disable setting into the memory of the local system computer 10 and scrolls to the configuration menu for the alarm-message enable/disable selection mode.

The plurality of configuration items of the configuration menu includes the alarm-message enable/disable adjustment mode. The alarm-message is a factory default voice message that follows an alarm consisting of three short, high-frequency beep pattern that is activated whenever the signal level indication on the display screen is greater than the alarm setpoint but is lower than the high-alarm setpoint. The factory default configuration setting of the alarm-message enable/disable mode is enabled. FIG. 31 appears on the display screen 25 if the alarm-message is enabled and FIG. 32 appears on the display screen 25 if the alarm-message is disabled. The raise pushbutton 32 is adapted to be pressed to enable the alarm-message while the lower pushbutton 31 is adapted to be pressed to disable the alarm-message. Pressing the test pushbutton 33 saves the alarm-message enable/disable setting into the memory of the local system computer 10 and scrolls to the configuration menu for the high-alarm-message enable/disable selection mode.

The plurality of configuration items of the configuration menu includes the high-alarm-message enable/disable adjustment mode. The high-alarm-message is a factory default voice message that follows a high-alarm consisting of four very short, very high-frequency beep pattern that is activated whenever the signal level indication on the display screen is greater than the high-alarm setpoint. The factory default configuration setting of the high-alarm-message enable/disable mode is enabled. FIG. 33 appears on the display screen 25 if the high-alarm-message is enabled and FIG. 34 appears on the display screen 25 if the alarm-message is disabled. The raise pushbutton 32 is adapted to be pressed to enable the high-alarm-message while the lower pushbutton 31 is adapted to be pressed to disable the high-alarm-message. Pressing the test pushbutton 33 saves the high-alarm-message enable/disable setting into the memory of the local system computer 10 and scrolls to the configuration menu for the startup-message enable/disable selection mode.

The plurality of configuration items of the configuration menu includes the startup-message enable/disable selection mode. The startup message is a factory default voice message that is annunciated when the local panel 1 is energized. The factory default configuration setting of the startup-message enable/disable is enabled. FIG. 35 appears on the display screen 25 if the startup message is enabled and FIG. 36 appears on the display screen 25 if the startup message is disabled. The raise pushbutton 32 is adapted to be pressed to enable the startup message while the lower pushbutton 31 is adapted to be pressed to disable the startup message. Pressing the test pushbutton 33 saves the alarm-message enable/disable setting into the memory of the local system computer 10 and scrolls to the configuration menu for the line-contact-message-length selection mode.

The plurality of configuration items of the configuration menu includes the line-contact-message-length. The line-contact message is a factory default voice message that follows a line-contact alarm consisting of one of the four line-contact alarm types that is actuated whenever the line-contact antenna 43 senses the existence of a high-voltage electric potential on the heavy-equipment 5 or vehicle relative to the potential of the ground immediately under the heavy-equipment 5 or vehicle. The factory default setting of the line-contact-message-length is ten seconds. FIG. 37 appears on the display screen 25 when the line-contact-message-length configuration selection is made. The raise pushbutton 32 is adapted to be pressed to raise the line-contact-message-length value to a maximum value of sixteen seconds in increments of two seconds while the lower pushbutton 31 is adapted to be pressed to lower the line-contact-message-length value to a minimum value of four seconds in increments of two seconds. Pressing the test pushbutton 33 saves the line-contact-message-length into the memories of the local system computer 10 and the remote system computer 41 and scrolls to the configuration menu for the line-contact-alarm type selection mode.

The plurality of configuration items of the configuration menu of the configuration menu includes the line-contact-alarm type selection. The line-contact-alarm is one-of-four possible alarm types that precedes the line-contact voice message that is actuated whenever the line-contact antenna 43 senses the existence of a high-voltage electric potential on the heavy-equipment 5 or vehicle relative to the potential of the ground immediately under the heavy-equipment or vehicle. The line-contact-alarm provides four possible selections of alarm types:

- line-contact-alarm type one consists of a sequence of eight alternating high-frequency tones and low-frequency tones;
- line-contact-alarm type two consists of a series of eight rising frequency wailing tones;
- line-contact-alarm type three consists of a series of eight warbling sounds; and
- line-contact-alarm type four consists of an eight second wailing tone.

The default line-contact-alarm type is type one. FIG. 38 appears on the display screen 25 when the line-contact-alarm type selection is made. The raise pushbutton 32 is adapted to be pressed to raise the value of the line-contact-alarm type to a maximum value of four while the lower pushbutton 31 is adapted to be pressed to lower the value of the line-contact-alarm type to a minimum value of one. Pressing the test pushbutton 33 saves the line-contact-alarm type selection into the memories of the local system computer 10 and the remote system computer 41 and scrolls to the configuration menu for the antenna-gain selection.

The plurality of configuration items of the configuration menu includes the antenna-gain selection mode. The antenna-gain selection provides a means to adjust the signal level indication as shown in FIG. 13 for a given antenna configuration and distance from high-voltage lines 40. The factory default setting of the antenna-gain setting is low. The local system computer 10 is adapted for user technician configurational adjustment of the three antenna-gain setting of low, medium and high. An increase of the antenna-gain setting from low to medium would result in an increase in the signal level indication on the display screen 10 by fifty percent as shown in FIG. 13; increasing the antenna-gain setting from medium to high would result in an additional increase in the signal level indication on the display screen 10 by thirty-three percent as shown in FIG. 13. Display-screen displays for antenna-gain settings are illustrated in FIGS. 39–41. The raise pushbutton 32 is adapted to be pressed to scroll upwardly through the antenna-gain settings while the lower pushbutton 31 is adapted to pressed to scroll downwardly through the antenna-gain settings. Pressing the test pushbutton 33 saves the antenna-gain setting into the memory of the local system computer 10 and scrolls to the configuration menu for the line-contact setpoint.

The plurality of the configuration items of the configuration menu includes the line-contact alarm setpoint adjustment mode. The line-contact alarm setpoint is set at a factory default value of fifteen line-contact signal units. The line-contact alarm setpoint is set after the line-contact sensor 46 portion of the line-contact antenna 43 is installed on a protected underside of heavy equipment 5 or other vehicle. The first line of the display screen 10 shown in FIG. 42 represents the line-contact signal level that would occur if the heavy equipment 5 or other vehicle was in direct contact with a high voltage source. The second line of the display screen 10 shown in FIG. 42 represents the line-contact alarm setpoint. The line-contact alarm sequence is initiated whenever the line-contact signal level exceeds the line-contact alarm setpoint. The line-contact alarm setpoint is adjusted by momentarily applying a one-hundred-and-fifteen volt signal to the heavy equipment 5 or vehicle and noting the value of the line-contact signal level on the first line of the display screen 10 shown in FIG. 42. The raise pushbutton 32 is adapted to be pressed to raise the line-contact alarm setpoint. The lower pushbutton 31 is adapted to be pressed to lower the line-contact alarm setpoint. The line-contact setpoint is adjusted to approximately four line-contact signal units below the noted line-contact signal level. The adjustment span of the line-contact alarm setpoint is adjustable from a minimum of one line-contact signal unit to a maximum of forty line-contact signal units. Pressing the test pushbutton 33 saves the line-contact alarm setpoint into the memory of the local system computer 10 and scrolls the configuration menu into the maximum alarm setpoint selection mode.

The plurality of configuration items in the configuration mode includes message playing and recording. While in the configuration mode, the local system computer 10 and the remote system computer 41 are adapted for playing all of the individual warnings or alarms along with their associated voice messages, and for recording all of the voice messages with an optional microphone plugged into the microphone jack 55 located on the remote panel 3. Alarms and warnings with their associated messages, are played by momentarily pressing one of the associated message test pushbuttons 18–23 located on the remote panel 3. Messages are recorded by first pressing the play/record pushbutton 17 followed by momentarily pressing one of the message pushbuttons 18–23. The message may be recorded while the play/record light 56 is lighted at which time both pushbuttons may be released.

An electrical line protector, which can include a fuse, can be positioned intermediate at least one data terminal on the remote panel and a remote communication device 50 to which the data terminal is connected for a remote function.

A method for using the high-voltage-proximity warning system has the following steps:

positioning the local panel 1 in or in the vicinity of the cab 2 of the heavy equipment 5 or vehicle within about six feet or less of a work space of the heavy-equipment operator where it is conveniently visible and hand-operable by the heavy-equipment operator or vehicle operator;

positioning the remote panel 3 in the vicinity of the local panel in a suitably protected environment where it is accessible by a user technician or by user supervisory personnel as appropriate for intended operating conditions;

positioning up to six of the proximity antennas 4 on the heavy equipment 5 or vehicle in positions for avoiding any shadowing of the electrical field from the proximity antennas;

electrically connecting the antenna cables from the proximity antennas 4 to the antenna jacks 8;

positioning the line-contact antenna an a protected underside of heavy equipment 5 or vehicle;

electrically connecting the line-contact antenna 43 to the line-contact antenna jack 45;

placing the data cable 36 in electrical communication intermediate the local data jack 34 and the remote jack 35; and electrically connecting the electrical-source terminal 11 on the remote panel 3 to positive and negative ignition conductors downstream electrically from an ignition terminal 51 of the heavy equipment 5.

The method for using further comprises:

electrically connecting desired remote functions which include selected warning and communication devices 50 to corresponding data terminals on the remote panel 3;

activating the configuration mode of the local system computer 10 and the remote system computer 41 by positioning the configuration cable 37 having a local data plug 38 in communication with the local data jack 34 and having an adapter plug 39 in communication with a first end of the data cable 36 that has a second end in communication with the remote data jack 35, as shown in FIGS. 6 and 10–12, and pressing the power pushbutton 30; and configuring the local system computer 10 and the remote system computer 41 in accordance with objectives and operating conditions of the heavy equipment or vehicle for which the high-voltage-proximity warning system is intended to be used and pushing the test pushbutton 33.

Configuring the local system computer 10 and the remote system computer 41 includes selecting and computer-saving features of the configuration items of the configuration menu that place desired limitations of operation of the operational menu by the heavy-equipment operator or vehicle operator with the local panel 1.

The method for using further comprises:

connecting desired speakers to speaker terminals 12 and other warning and communication devices 50 to the remote data terminals on the remote panel 3 selectively; and customizing communications with the desired speakers 12 and other warning and communication devices 50 for intended use conditions of the heavy equipment 5 or vehicle.

Customizing communications can include providing voice communications and further remote communication from the remote panel 3.

A new and useful high-voltage proximity system and method having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A high-voltage-proximity warning system comprising:

a local panel adapted for being positioned in predeterminedly operational, audio and visual nearness to a vehicle operator in or about a vehicle cab;

a remote panel adapted for being positioned in predeterminedly operational, audio and visual remoteness, from the local panel;

the local panel having pushbuttons for quick, easy and unobstructed operation of the local panel;

one or more electrical-field-sensing proximity antennas that are adapted for being positioned selectively on the vehicle;

the one or more electrical-field-sensing proximity antennas having antenna cables with antenna plugs that are connectable to antenna jacks on the local panel for being in predetermined electrical communication with a local system computer on the local panel;

the remote panel having a plurality of electrical terminals which include a double-poled electrical-source terminal;

the remote panel having a plurality of remote data terminals which include one or more speaker terminals, one or more warning relays, one or more high-warning relays, one or more alarm relays, one or more high-alarm relays, a play/record test pushbutton, a play/record indicating light, a microphone jack, a warning-message test pushbutton, a high-warning-message test pushbutton, an alarm-message test pushbutton, a high-alarm-message test pushbutton, a startup-message test pushbutton, and a line-contact-message test pushbutton in predetermined communication with the remote system computer;

the local panel having a plurality of local data transmitters which include a display screen, a warning light, a high-warning light, an alarm light, a high-alarm-light, an on/off power pushbutton, a lower pushbutton, a raise pushbutton, and a test pushbutton in predetermined communication with the local system computer;

the local panel having a local data jack in predetermined electrical communication with the local system computer;

the remote panel having a remote data jack in predetermined electrical communication with the remote system computer;

a data cable adapted for conveyance of electrical current from the remote panel and for data communication intermediate the local data jack and the remote data jack;

the local system computer being adapted and positioned to receive, to computer process and to communicate high-voltage sensing data from the proximity antennas for communication to and for relay by communication and warning devices through the display screen, through the local data transmitters and to and from the remote system computer;

the remote system computer being adapted and positioned to receive, to computer process and to communicate data to and from the local system computer and to the remote data terminals predeterminedly; and the local system computer having a configuration menu for configuring an operation menu for operating the local system computer within features of items of the configuration menu.

2. The high-voltage-proximity warning system of claim 1 wherein:

the configuration menu is adapted for being accessible with a configuration cable having a local data plug in communication with a first end of the data cable that has a second end in communication with the remote data jack.

3. The high-voltage-proximity warning system of claim 1 wherein:

the one or more proximity antennas include a plurality of up to six proximity antennas.

4. The high-voltage-proximity warning system of claim 3 wherein:

the plurality of up to six proximity antennas are positioned on portions of the vehicle devices for avoiding shadowing of directional electrical-field sensing by the proximity antennas, such that all directions from the vehicle devices are exposed to electrical-field sensing by the proximity antennas.

5. The high-voltage-proximity warning system of claim 4 wherein:

the electrical communication of the proximity antenna with the local panel includes communication of a predeterminedly low-voltage of electricity from the local panel to the proximity antennas for creating a testing circuit of electricity intermediate active portions of the proximity antennas and the local panel predeterminedly.

6. The high-voltage-proximity warning system of claim 5 and further comprising:

a low-voltage functional testing current intermediate an antenna display status to the display screen and all portions of the proximity antennas and line-contact antenna.

7. The high-voltage proximity warning system of claim 3 wherein:

the plurality of up to six of the proximity antennas each including an active portion and an inactive portion;

the active portion is an electrical-field sensing portion consisting of a two-conductor cable whose conductors are connected at distal ends of each of the proximity antennas which provides an electrical current path for a low-voltage antenna testing current;

the electric field of high-voltage lines capacitively couples a signal voltage from the high-voltage line to the active portion of the proximity antenna;

the inactive portion includes a shielded, two-conductor cable for electrical communication intermediate the active portion of the proximity antenna and the display screen of the local panel;

the antenna cable is terminated with an antenna plug; and the antenna plug includes three-conductor pins, two of which are connected to the two conductors of the inactive portion of the proximity antenna and one of which is connected to the shield of the inactive portion of the proximity antenna.

8. The high-voltage-proximity warning system of claim 7 and further comprising:

a predeterminedly small DC electrical current for continuously checking electrical continuity of the proximity antenna against short-circuits, open circuits or electrical grounding.

9. The high-voltage proximity warning system of claim 1 and further comprising:

a line-contact alarm on the local panel;

the line-contact alarm including a separately dedicated circuit to a line-contact antenna located on a protected underside of the vehicle for separately sensing and communicating to the local system computer the existence of a high-voltage electrical potential on the vehicle relative to the potential of the ground immediately below the vehicle;

the line-contact antenna includes shielded four-conductor cable that is in electrical communication with a line-contact sensor;

the shielded four-conductor cable being terminated by a four-conductor plug on the local panel;

the four-conductor plug including four conductor pins;

the first two of the four-conductor pins being in electrical communication with the line-contact sensor;

a third one of the four-conductor pins being connected to the shield of the shielded two-conductor cable; and a fourth of the four-conductor pins being reserved for future use.

10. The high-voltage-proximity warning system of claim 1 wherein:

the display screen on the local panel includes a first line of information and a second line of information;

the first line of information includes a display of signal level value indication of the highest weighted signal level that is sensed on all of the proximity antennas;

the signal level indication ranges from-one-to-ninety-nine;

the second line of information includes a display of a setting of an alarm setpoint which is included in the operational menu that can be adjusted by the vehicle operator with the raise and lower pushbuttons.

11. The high-voltage-proximity warning system of claim 1 wherein:

the local system computer is adapted for the display screen to display a warning-message to the operator in the event of a failure or fault of a proximity antenna or line-contact antenna;

the warning-message includes the identity of any one or more faulted proximity antennas or line-contact antenna; and the local system computer is adapted to alternate the antenna fault message status on the display screen with the normal display while the antenna failure or fault is in effect.

12. The high-voltage-proximity warning system of claim 1 wherein:

the system computer is adapted for the display screen to display a warning-message to the vehicle operator in the event of failure of communication between the local panel and the remote panel; and the local system computer is adapted to alternate the communication failure message on the display screen with the normal display while the communication failure or fault is in effect.

13. The high-voltage-proximity warning system of claim 1 wherein:

the alarm light on the local panel is adapted to be factory set-with the local system computer for actuation at a proximity-antenna closeness to high-voltage lines that will result in a signal level indication that is equal or greater than the alarm setpoint as shown on the display screen;

the range within which the alarm setpoint can be set by the vehicle operator is adapted to be set by a user technician while in the configuration mode;

the alarm setpoint is adapted to be adjustable by the vehicle operator between a minimum value of ten signal units and a maximum value of the maximum alarm setpoint such that the vehicle operator is prevented from inadvertently setting the alarm setpoint at a dangerously high level; and the maximum alarm setpoint is programmable from forty-to-eighty signal units by the user technician with the local system computer in the configuration mode.

14. The high-voltage-proximity warning system of claim 13 wherein:

communication from the local system computer for actuation of the alarm light includes predetermined communication to the remote system computer and subsequently to the additional alarm and communication devices;

wherein the communication devices includes a factory default alarm voice message and a factory default alarm beep pattern that consists of three short, high-frequency beeps that is actuated whenever the signal level indication on the display screen is greater than the alarm setpoint but is lower than the high-alarm setpoint and a line-contact alarm condition is not actuated;

the alarm voice message is alternated with the alarm beep pattern while the alarm is activated;

the user technician can disable or change the content of the alarm voice message with the local system computer in the configuration mode;

while an alarm condition is actuated and the alarm voice message is disabled, the alarm beep pattern continues until the signal level decreases below the alarm setpoint or the signal level increases above the high-alarm setpoint and a line-contact alarm condition is not actuated; and the warning light, the high-warning light and the alarm light are lit while an alarm condition is actuated and a line-contact alarm condition is not actuated.

15. The high-voltage-proximity warning system of claim 1 wherein:

the local system computer is programmed for the high-alarm-light to be actuated by actuation of the alarm light followed by continued approach towards high-voltage lines;

a factory default setting for actuation of the high-alarm-light of ten signal units greater than the alarm setpoint; and the value of the setpoint of the high-alarm-light is adjustable from four-to-twenty signal units above the alarm setpoint by the user technician with the local system computer in the configuration mode.

16. The high-voltage-proximity warning system of claim 15 wherein:

communication from the local system computer for actuation of the high-alarm-light includes predetermined communication to the remote system computer and subsequently to the additional high-alarm and communication devices;

included in the optional communication is a factory default high-alarm voice message and a factory default high-alarm beep pattern that consists of four very short, very high-frequency beeps that is activated whenever the signal level indication on the display screen is greater than the high-alarm setpoint;

the high-alarm voice message is alternated with the high-alarm beep pattern while the high-alarm is activated;

the user technician can disable or change the content of the high-alarm voice message with the local system computer in the configuration mode;

while a high-alarm condition is actuated and the high-alarm voice message is disabled, the high-alarm beep pattern continues until the signal level decreases below the high-alarm setpoint and a line-contact alarm condition is not actuated; and the warning light, the high-warning light, the alarm light and the high-alarm-light are lit while a high-alarm condition is actuated and a line-contact alarm condition is not actuated.

17. The high-voltage-proximity warning system of claim 1 wherein:

the local system computer is programmed for the high-warning light to be actuated by actuation of the warning light followed by continued approach towards high-voltage lines;

the factory default setting for the actuation of the high-warning light is ten signal units below alarm setpoint; and the value of the high-warning light setpoint is adjustable from four-to-twenty signal units below the alarm light setpoint by the user technician with the local system computer in the configuration mode.

18. The high-voltage-proximity warning system of claim 17 wherein:

communication from the local system computer for actuation of the high-warning light includes predetermined communication to the remote system computer and subsequently to the additional high-warning and communication devices;

included in the communication devices is a factory default high-warning voice message and a factory default high-warning beep pattern that consists of two long, low frequency beeps that is activated whenever the signal level indication on the display screen is greater that the high-warning setpoint but is lower than the alarm setpoint and a line-contact alarm condition is not actuated;

the high-warning voice message is alternated with the high-warning beep pattern while the high-warning is actuated;

the user technician disable or change the content of the high-warning voice message with the local system computer in the configuration mode;

while a high-warning condition is actuated and the high-warning voice message is disabled, the high-warning beep pattern continues until the signal level decreases below the high-warning setpoint or the signal level increases above the alarm setpoint and a line-contact alarm condition is not actuated; and the warning light and the high-warning light are lit while a high-warning condition is actuated and a line-contact alarm condition is not actuated.

19. The high-voltage-proximity warning system of claim 1 wherein:

the local system computer is programmed for the warning light to be actuated by approach towards high-voltage lines;

the factory default setting for actuation of the warning light is ten signal units below the high-warning setpoint; and the value of the warning light setpoint is adjustable from four-to-twenty signal units below the setting of the high-warning setpoint by the user technician with the local system computer in the configuration mode.

20. The high-voltage-proximity warning system of claim 19 wherein:

communication from the local system computer for actuation of the warning light includes predetermined communication to the remote system computer and subsequently to the additional warning and communication devices;

included in the communication devices is a factory default warning voice message and a factory default warning beep that consists of one very long, very low frequency beep that is activated whenever the signal level indication on the display screen is greater than the warning setpoint but is lower than the high-warning setpoint and a line-contact warning condition is not actuated;

the warning voice message is alternated with the warning beep pattern while the warning is actuated;

the user technician can disable or change the content of the warning voice message with the local system computer in the configuration mode; and while the warning condition is actuated and the warning voice message is disabled, the warning beep pattern continues until the signal level decreases below the warning setpoint or the signal level increases above the high-warning setpoint and a line-contact alarm condition is not actuated.

21. The high-voltage-proximity warning system of claim 1 wherein:

the local system computer is programmed for the line-contact alarm to be actuated whenever high-voltage lines come into direct contact with a vehicle;

a line-contact sensor is fastened to the protected underside of vehicle whose function is to sense the electric field as a result of a difference in electrical potential between the vehicle and the earth beneath the vehicle;

a factory default setting for actuation of the line-contact alarm is fifteen line-contact signal units; and the value of the line-contact setpoint is adjustable from one-to-forty line-contact signal units by the user technician with the local system computer in the configuration mode.

22. The high-voltage-proximity warning system of claim 21 wherein:

communication from the local system computer for the actuation of the warning light, the high-warning light, the alarm light and the high-alarm-light includes communication to the remote system computer and subsequently to the additional warning and communication devices;

wherein the communication devices include a factory default line-contact alarm voice message and a factory default alarm pattern that is activated whenever the line-contact signal exceeds the line-contact alarm setpoint and is deactivated whenever the line-contact signal decreases below the line-contact alarm setpoint;

wherein while the line-contact alarm is activated, the line-contact alarm voice message is alternated with the line-contact alarm pattern and the warning light, the high-warning light, the alarm light and the high-alarm-light all blink in a predetermined pattern; and the user technician can change the content of the line-contact alarm voice message and select one of four line-contact alarm patterns with the local system computer in the configuration mode.

23. The high-voltage-proximity warning system of claim 21 wherein:

the proximity antenna circuitry senses the voltage difference between the voltage induced into the proximity antenna and the voltage induced into the vehicle;

the vehicle may or may not be at ground potential;

the line-contact circuitry includes a correction signal to the proximity antenna circuitry in the event that an ungrounded or partially ungrounded heavy equipment or vehicle comes into close proximity to high-voltage lines thereby inducing a voltage into the vehicle resulting in a lower voltage differential between the proximity antenna and the vehicle; and the line-contact sensor senses the voltage difference between the vehicle and the earth directly beneath the vehicle and provides the correction signal to the proximity antenna circuitry thereby eliminating the signal level error that would result from using an ungrounded or partially ungrounded vehicle.

24. The high-voltage-proximity warning system of claim 1 wherein:

the local system computer is programmed for a startup message to be actuated when the local panel is initially energized;

the factory default setting for the actuation of the startup message is enabled;

the startup message can be enabled or disabled or changed in content by the user technician with the local system computer in the configuration mode; and wherein while the startup message is activated, a warning, a high-warning, an alarm, a high-alarm or a line-contact alarm will override the startup message.

25. The high-voltage-proximity warning system of claim 1 wherein:

the power pushbutton is adapted for actuation by the vehicle operator for energizing the high-voltage proximity warning system through the remote panel which is energized downstream electrically from an ignition terminal that has been turned on.

26. The high-voltage-proximity warning system of claim 25 wherein:

a default safety precaution is programmed into the local system computer to avoid danger and damage from turning on the ignition terminal and operating a vehicle without activating the power pushbutton;

the default safety precaution includes adaptation of the local panel to be energized without energizing the display screen and for wakeup and alarm from occurrence of a signal level to the alarm setpoint as though the power pushbutton were pressed;

the local panel then cannot be turned off by the power pushbutton while the alarm condition is still in effect;

the default safety precaution is programmable by the user technician for wake-up whenever the signal level equals either the warning light setpoint, the high-warning light setpoint, the alarm light setpoint or the high-alarm-light setpoint; and the default safety precaution is terminable by the user technician with the local system computer in the configuration mode.

27. The high-voltage-proximity warning system of claim 1 wherein:

the lower pushbutton is adapted for use by the vehicle operator to decrease the alarm setpoint while the local panel is not in the configuration mode;

the raise pushbutton is adapted for use by the vehicle operator to increase the alarm setpoint while the local panel computer is in the normal mode;

the alarm setpoint is not changed by turning the local panel on or off;

the minimum value of the alarm setpoint is ten signal units as displayed on the display screen;

the maximum value of the alarm setpoint is the value of the maximum alarm setpoint set by the user technician while the local panel is in the configuration mode; and the lower pushbutton and the raise pushbutton are adapted for use by the user technician while the local panel is in the configuration mode.

28. The high-voltage-proximity warning system of claim 1 wherein:

the test pushbutton is adapted for use by the vehicle operator to indicate the absence or existence of antenna faults when pressed while the local panel is not in the configuration mode;

codes are provided for indicating which, if any, of the proximity antennas or line-contact antenna are faulted; and wherein while the local panel is in the configuration mode, the test pushbutton is adapted to select various configuration modes and to save the configuration settings into the memory of the local system computer and remote system computer.

29. The high-voltage-proximity warning system of claim 1 wherein:

the local panel is adapted to be mounted within approximately six feet of the vehicle operator for providing full view of the local panel and for providing immediately convenient access to control pushbuttons;

the local panel includes two brackets having attachment-fastener knobs for secure mounting in any foreseeable geometry on or about a vehicle;

the brackets are adapted for elevation of the local panel underside of the local panel for ease of attaching proximity antennas, line-contact antenna, data cable and configuration cable where it will not obstruct the activities of the vehicle operator;

the local panel is adapted for protection against the elements, for rugged use and for harsh environments with connections to the local panel being watertight; and additional protection can be provided for environments that include highly conductive contaminants of a type that includes coal dust by applying silicon grease to the mating parts of the cable connectors and plugs.

30. The high-voltage-proximity warning system of claim 1 wherein:

the data cable has an two eight-pin female plugs that are adapted for a first data-cable plug to be plugged into a remote panel jack on the remote panel and a second data-cable plug to be plugged into a local data jack on the local panel underside of the local panel.

31. The high-voltage-proximity warning system of claim 1 wherein:

the remote panel is adapted for being mounted in proximity to the local panel in a less harsh environment than for the local panel; and the remote panel is adapted for a plurality of electrical connections in a predeterminedly protected enclosure.

32. The high-voltage-proximity warning system of claim 1 wherein:

the configuration menu of the local system computer is accessible by the user technician and is adapted for being accessible by pushing the power pushbutton after placing the configuration cable having the local data plug in communication with the local data jack and having the adapter plug in communication with a second end of the data cable that has a first end in communication with the remote data jack;

the configuration menu includes a plurality of configuration items;

the configuration items are accessed sequentially by pressing the test pushbutton thereby saving the value of the previously displayed configuration into the memories of the local system computer and the remote system computer;

wherein while in the configuration mode, if the power is removed by any means, the value of the current configuration item shown on the display screen is not saved into the memories of the local system computer or the remote system computer; and the configuration items include selections that are adjustable by pressing the raise pushbutton and the lower pushbutton.

33. The high-voltage-proximity warning system of claim 32 wherein:

the maximum alarm setpoint is adjustable between a minimum value of forty signal units and a maximum value of eighty signal units allowing the vehicle operator to adjust the alarm s,setpoint on the display screen between a low value of ten and a high value of the maximum alarm setpoint.

34. The high-voltage-proximity warning system of claim 32 wherein:

the plurality of configuration items of the configuration menu includes a panel wake-up that is adapted to activate the high-voltage proximity warning system without pushing the power pushbutton in the event that the vehicle comes into sufficient proximity of high-voltage lines such that the resulting signal level would equal or exceed the warning-light setpoint;

wherein the panel wake-up is adapted for five user technician options of wake-up modes which include:

wakeup for warning light actuation and warning actions whenever the signal level exceeds the warning setpoint;

wakeup for high-warning light actuation and high-warning actions whenever the signal level exceeds the high-warning setpoint;

wakeup for alarm light actuation and alarm actions whenever the signal level exceeds the alarm setpoint;

wakeup for high-alarm-light actuation and alarm actions whenever the signal level exceeds the high-alarm setpoint; and wakeup mode disabled for totally disabling the panel wakeup;

the raise pushbutton is adapted to be pressed for scrolling upwardly through the wakeup modes which appear on the display screen;

the lower pushbutton is adapted to be pressed for scrolling downwardly through the wakeup modes which appear on the display screen;

the selected wakeup mode is set by pressing the test pushbutton; and pressing the test pushbutton saves the wakeup mode into the memory of the local system computer and scrolls the configuration menu to a warning-light span adjustment mode.

35. The high-voltage-proximity warning system of claim 32 wherein:

the plurality of configuration items of the configuration menu includes a warning-light span wherein the warning-light span is the signal level difference between the warning-light setpoint and the high-warning-light setpoint;

the factory default setting of the warning light span is ten signal units;

the local computer system is adapted for user technician configurational adjustment of the warning light span between a minimum value of four signal units to a maximum value of twenty signal units;

the warning light span is displayed on the display screen during the warning light span adjustment;

the raise pushbutton is adapted to be pressed to raise the warning light span to a maximum value of twenty signal units while the lower pushbutton is adapted to be pressed to lower the warning light span to a minimum value of four signal units; and pressing the test pushbutton saves the warning light span value into the memory of the local system computer and scrolls the configuration menu into the high-warning-light span adjustment mode.

36. The high-voltage-proximity warning system of claim 32 wherein:

the plurality of configuration items of the configuration menu includes the high-warning-light span wherein the high-warning-light span is the signal level difference between the high-warning-light setpoint and the alarm setpoint;

the factory default setting of the high-warning-light setpoint is ten signal units;

the local system computer is adapted for user technician configurational adjustment of the high-warning-light span between a minimum value of four signal units to a maximum value of twenty signal units;

the high-warning light span is displayed on the display screen during the high-warning light span adjustment;

the raise pushbutton is adapted to be pressed to raise the high-warning-light span to a maximum value of twenty signal units while the lower pushbutton is adapted to be pressed to lower the high-warning-light span to a minimum value of four signal units; and pressing the test pushbutton saves the high-warning-light span value into the memory of the local system computer and scrolls the configuration menu into the high-alarm-light span adjustment mode.

37. The high-voltage-proximity warning system of claim 32 wherein:

the plurality of configuration items of the configuration menu includes the high-alarm-light span wherein the high-alarm-light span is the signal level difference between the alarm setpoint and the high-alarm-light setpoint;

the factory default setting of the high-alarm-light setpoint is ten signal units;

the local system computer is adapted for user technician configurational adjustment of the high-alarm-light span between a minimum value of four signal units to a maximum value of twenty signal units;

the high-alarm-light span is displayed on the display screen during the high-alarm-light span adjustment;

the raise pushbutton is adapted to be pressed to raise the high-alarm-light span to a maximum value of twenty signal units while the lower pushbutton is adapted to be pressed to lower the high-alarm-light span to a minimum value of four signal units; and pressing the test pushbutton saves the high-alarm-light span value into the memory of the local system computer and scrolls the configuration menu into the warning-message enable/disable selection mode.

38. The high-voltage-proximity warning system of claim 32 wherein:

the plurality of configuration items of the configuration menu includes the warning-message enable/disable adjustment mode, wherein the warning-message is a factory default voice message that follows a warning consisting of one very long, very low frequency beep pattern that is activated whenever the signal level indication on the display screen is greater than the warning setpoint but is lower than the high-warning setpoint;

the factory default configuration setting of the warning-message enable/disable mode is enabled;

the warning-message enable/disable status is displayed on the display screen during the selection process;

the raise pushbutton is adapted to be pressed to enable the warning-message while the lower pushbutton is adapted to be pressed to disable the warning-message; and pressing the test pushbutton saves the warning-message enable/disable setting into the memory of the local system computer and the remote computer and scrolls to the configuration menu for the high-warning-message enable/disable selection mode.

39. The high-voltage-proximity warning system of claim 32 wherein:

the plurality of configuration items of the configuration menu includes the high-warning-message enable/disable adjustment mode wherein the high-warning-message is a factory default voice message that follows a high-warning consisting of two long, low frequency beep pattern that is activated whenever the signal level indication on the display screen is greater than the high-warning setpoint but is lower than the alarm setpoint;

the factory default configuration setting of the high-warning-message enable/disable mode is enabled;

the high-warning-message enable/disable status is displayed on the display screen during the selection process;

the raise pushbutton is adapted to be pressed to enable the high-warning-message while the lower pushbutton is adapted to be pressed to disable the high-warning-message; and pressing the test pushbutton saves the high-warning-message enable/disable setting into the memory of the local system computer and remote system computer and scrolls to the configuration menu for the alarm-message enable/disable selection mode.

40. The high-voltage-proximity warning system of claim 32 wherein:

the plurality of configuration items of the configuration menu includes the alarm-message enable/disable adjustment mode wherein the alarm-message is a factory default voice message that follows an alarm consisting of three short, high-frequency beep pattern that is activated whenever the signal level indication on the display screen is greater than the alarm setpoint but is lower than the high-alarm setpoint;

the factory default configuration setting of the alarm-message enable/disable mode is enabled;

the alarm-message enable/disable status is displayed on the display screen during the selection process;

the raise pushbutton is adapted to be pressed to enable the alarm-message while the lower pushbutton is adapted to be pressed to disable the alarm-message; and pressing the test pushbutton saves the alarm-message enable/disable setting into the memory of the local system computer and scrolls to the configuration menu for the high-alarm-message enable/disable selection mode.

41. The high-voltage-proximity warning system of claim 32 wherein:

the plurality of configuration items of the configuration menu includes the high-alarm-message enable/disable adjustment mode wherein the high-alarm-message is a factory default voice message that follows a high-alarm consisting of four very short, very high-frequency beep pattern that is activated whenever the signal level indication on the display screen is greater than the high-alarm setpoint;

the factory default configuration setting of the high-alarm-message enable/disable mode is enabled;

the high-alarm-message enable/disable status is displayed on the display screen during the selection process;

the high-alarm-message enable/disable status is displayed on the display screen during the selection process;

the raise pushbutton is adapted to be pressed to enable the high-alarm-message while the lower pushbutton is adapted to be pressed to disable the high-alarm-message; and pressing the test pushbutton saves the high-alarm-message enable/disable setting into the memory of the local system computer and scrolls to the configuration menu for the startup-message enable/disable selection mode.

42. The high-voltage-proximity warning system of claim 32 wherein:.

the plurality of configuration items of the configuration menu includes the startup-message enable/disable selection mode wherein the startup message is a factory default voice message that is annunciated when the local panel is energized;

the factory default configuration setting of the startup-message enable/disable is enabled;

the startup message enable/disable status is displayed on the display screen during the selection process;

the raise pushbutton is adapted to be pressed to enable the startup message while the lower pushbutton is adapted to be pressed to disable the startup message; and pressing the test pushbutton saves the alarm-message enable/disable setting into the memory of the local system computer and scrolls to the configuration menu for the line-contact-message-length selection mode.

43. The high-voltage-proximity warning system of claim 32 wherein:

the plurality of configuration items of the configuration menu includes the line-contact-message-length wherein the line-contact message is a factory default voice message that follows a line-contact alarm consisting of one of the four line-contact alarm types that is actuated whenever the line-contact antenna senses the existence of a high-voltage electric potential on the vehicle relative to the potential of the ground immediately under the vehicle;

the factory default setting of the line-contact-message-length is ten seconds;

the line-contact-message-length is displayed on the display screen during the line-contact-message-length adjustment;

the raise pushbutton is adapted to be pressed to raise the line-contact-message-length value to a maximum value of sixteen seconds in increments of two seconds while the lower pushbutton is adapted to be pressed to lower the line-contact-message-length value to a minimum value of four seconds in increments of two seconds; and pressing the test pushbutton saves the line-contact-message-length into the memories of the local system computer and the remote system computer and scrolls to the configuration menu for the line-contact-alarm type selection mode.

44. The high-voltage-proximity warning system of claim 32 wherein:

the plurality of configuration items of the configuration menu of the configuration menu includes the line-contact-alarm type selection wherein the line-contact-alarm is one-of-four possible alarm types that precedes the line-contact voice message that is actuated whenever the line-contact antenna senses the existence of a high-voltage electric potential on the vehicle relative to the potential of the ground immediately under the vehicle;

line-contact-alarm type one consists of a sequence of eight alternating high-frequency tones and low-frequency tones;

line-contact-alarm type two consists of a series of eight rising frequency whoops;

line-contact-alarm type three consists of a series of eight wailing tones;

line-contact-alarm type four consists of an eight second wailing tone;

the default line-contact-alarm type is type one;

the line-contact-alarm type is displayed on the display screen during the selection process;

the raise pushbutton is adapted to be pressed to raise the value of the line-contact-alarm type to a maximum value of four while the lower pushbutton is adapted to be pressed to lower the value of the line-contact-alarm type to a minimum value of one; and pressing the test pushbutton saves the line-contact-alarm type selection into the memories of the local system computer and the remote system computer and scrolls to the configuration menu for the antenna-gain selection.

45. The high-voltage-proximity warning system of claim 32 wherein:

the plurality of configuration items of the configuration menu includes the antenna-gain selection mode wherein the antenna-gain selection provides a means to adjust the signal level indication for a given antenna configuration and distance from high-voltage lines;

the factory default setting of the antenna-gain setting is low;

the local system computer is adapted for user technician configurational adjustment of the three antenna-gain settings of low, medium and high;

an increase of the antenna-gain setting from low to medium would result in an increase in the signal level indication on the display screen by fifty percent;

wherein increasing the antenna-gain setting from medium to high would result in an additional increase in the signal level indication on the display screen by thirty-three percent;

the antenna-gain setting status is displayed on the display screen during the selection process;

the raise pushbutton is adapted to be pressed to scroll upwardly through the antenna-gain settings while the lower pushbutton is adapted to pressed to scroll downwardly through the antenna-gain settings; and wherein pressing the test pushbutton saves the antenna-gain setting into the memory of the local system computer and scrolls to the configuration menu for the line-contact setpoint.

46. The high-voltage-proximity warning system of claim 32 wherein:

the plurality of the configuration items of the configuration menu includes the line-contact alarm setpoint adjustment mode wherein the line-contact alarm setpoint is set at a factory default value of fifteen line-contact signal units;

the line-contact alarm setpoint is set after the line-contact sensor portion of the line-contact antenna is installed on a protected underside of vehicle;

the first line of the display screen represents the line-contact signal level that would occur if the vehicle was in contact with a high voltage source;

the second line of the display screen represents the line-contact alarm setpoint;

the line-contact alarm sequence is initiated whenever the line-contact signal level exceeds the line-contact alarm setpoint;

the line-contact alarm setpoint is adjusted by momentarily applying a one-hundred-and-fifteen volt signal to the vehicle and noting the value of the line-contact signal level on the first line of the display screen;

the raise pushbutton is adapted to be pressed to raise the line-contact alarm setpoint;

the lower pushbutton is adapted to be pressed to lower the line-contact alarm setpoint;

the line-contact setpoint is adjusted to approximately four line-contact signal units below the noted line-contact signal level;

the adjustment span of the line-contact alarm setpoint is adjustable from a minimum of one line-contact signal to a maximum of forty line-contact signal units; and pressing the test pushbutton saves the line-contact alarm setpoint into the memory of the local system computer and scrolls the configuration menu into the maximum alarm setpoint selection mode.

47. The high-voltage-proximity warning system of claim 32 wherein:

the plurality of configuration items in the configuration mode includes message playing and recording;

wherein while in the configuration mode, the local system computer and the remote system computer are adapted for playing all of the individual warnings or alarms along with their associated voice messages, and for recording all of the voice messages with an optional microphone plugged into the microphone jack located on the remote panel;

alarms and warnings with their associated messages are played by momentarily pressing one of the associated message test pushbuttons located on the remote panel; and messages are recorded by first pressing the play/record pushbutton followed by momentarily pressing at least one message pushbutton until the play/record light is lighted at which time both the at least one message pushbutton may be released.

48. The high-voltage-proximity warning system of claim 1 wherein:

an electrical line protector, which can include a fuse, can be positioned intermediate at least one data terminal on the remote panel and a remote communication device to which the data terminal is connected for a remote function.

49. The high-voltage-proximity warning system of claim 1 wherein:

the local panel has a waterproof sealing of all internal and external components, including connections, lights, the display window, pushbuttons, the system computer and all electrical and electronic parts, wires and circuits;

all antenna jacks and data jacks are adapted for receiving silicon grease on the mating surfaces to prevent entry of particles that are finer than water, said particles of a type including coal dust, for particularly harsh environments; and wherein the local panel is adapted to be fastened to an attachment bracket having side walls with which a bottom surface of the local panel is raised for allowing ease of access to the antenna jacks, the line-contact jack and the data hack which are positioned on the bottom surface of the local panel.

50. A method comprising the following steps for using the high-voltage-proximity warning system described in claim 1:

positioning the local panel within approximately six feet of a work space of the vehicle operator where said local panel is conveniently visible and hand-operable by the vehicle operator;

positioning the remote panel in a vicinity of the local panel in a suitably protected environment where it is accessible by a user technician for intended operating conditions;

positioning up to six of the proximity antennas on the vehicle in positions for avoiding any shadowing of an electrical field from the proximity antennas;

electrically connecting the antenna cables from the proximity antennas to the antenna jacks;

positioning the line-contact antenna on a protected underside of the vehicle;

electrically connecting the line-contact antenna to the line-contact antenna jack;

placing the data cable in electrical communication intermediate the local data jack and the remote jack;

electrically connecting the electrical-source terminal on the remote panel to positive and negative ignition conductors downstream electrically from an ignition terminal of the vehicle; and electrically connecting desired remote functions which include selected communication and warning devices to corresponding data terminals on the remote panel.

51. The method of claim 50 further comprising:

activating the configuration mode of the local system computer and the remote system computer by positioning the configuration cable having a local data plug in communication with the local data jack and having an adapter plug in communication with a first end of the data cable that has a second end in communication with the remote data jack, and pressing the power pushbutton;

configuring the local system computer and the remote system computer in accordance with objectives and operating conditions of the vehicle for which the high-voltage-proximity warning system is intended to be used;

configuring the local system computer and the remote system computer includes selecting and computer-saving features of the configuration items of the configuration menu that place desired limitations of operation by the vehicle operator; and customizing communications with the desired speakers and other warning and communication devices for intended use conditions of the vehicle.

52. The method of claim 51 wherein:

the configuration menu includes a plurality of configuration items;

the configuration items are accessed and modified by pressing the raise pushbutton for raising the value of the configuration item, pressing the lower pushbutton for lowering the value of the configuration item and by pressing the test pushbutton for saving and sequencing the configuration items; and wherein configuration selections made without either pressing the test pushbutton prior to disconnecting the configuration cable or down-powering the local panel are not saved to memory.

53. The method of claim 52 wherein:

the plurality of configuration items of the configuration menu includes maximum alarm setpoint is adjustable between a minimum value of forty signal units and a maximum value of eighty signal units to allow the vehicle operator to adjust the alarm setpoint on the display screen between a low value of ten and a high value of the maximum alarm setpoint;

the plurality of configuration items of the configuration menu includes a panel wake-up that is adapted to activate the high-voltage proximity warning system without pushing the power pushbutton in the event that the vehicle comes into sufficient proximity of high-voltage lines such that the resulting signal level would equal or exceed the warning-light setpoint;

the panel wake-up is adapted for five user technician options of wake-up modes which include:

wakeup for warning light actuation and warning actions whenever the signal level exceeds the warning setpoint;

wakeup for high-warning light actuation and high-warning actions whenever the signal level exceeds the high-warning setpoint;

wakeup for alarm light actuation and alarm actions whenever the signal level exceeds the alarm setpoint;

wakeup for high-alarm-light actuation and alarm actions whenever the signal level exceeds the high-alarm setpoint; and wakeup mode disabled for totally disabling the panel wakeup;

the raise pushbutton is adapted to be pressed for scrolling upwardly through the wakeup modes which appear on the display screen;

the lower pushbutton is adapted to be pressed for scrolling downwardly through the wakeup modes which appear on the display screen;

the selected wakeup mode is set by pressing the test pushbutton;

pressing the test pushbutton saves the wakeup mode into the memory of the local system computer and scrolls the configuration menu to the warning-light span adjustment mode;

the plurality of configuration items of the configuration menu includes the warning-light span;

the warning-light span is the signal level difference between the warning-light setpoint and the high-warning-light setpoint;

the factory default setting of the warning light span is ten signal units;

the local computer system is adapted for user technician configurational adjustment of the warning light span between a minimum value of four signal units to a maximum value of twenty signal units;

the warning light span is displayed on the display screen during the warning light span adjustment;

the raise pushbutton is adapted to be pressed to raise the warning light span to a maximum value of twenty signal units while the lower pushbutton is adapted to be pressed to lower the warning light span to a minimum value of four signal units;

pressing the test pushbutton saves the warning light span value into the memory of the local system computer and scrolls the configuration menu into the high-warning-light span adjustment mode;

the plurality of configuration items of the configuration menu includes the high-warning-light span;

the high-warning-light span is the signal level difference between the high-warning-light setpoint and the alarm setpoint;

the factory default setting of the high-warning-light setpoint is ten signal units;

the local system computer is adapted for user technician configurational adjustment of the high-warning-light span between a minimum value of four signal units to a maximum value of twenty signal units;

the high-warning light span is displayed on the display screen during the high-warning light span adjustment;

the raise pushbutton is adapted to be pressed to raise the high-warning-light span to a maximum value of twenty signal units while the lower pushbutton is adapted to be pressed to lower the high-warning-light span to a minimum value of four signal units;

pressing the test pushbutton saves the high-warning-light span value into the memory of the local system computer and scrolls the configuration menu into the high-alarm-light span adjustment mode;

the plurality of configuration items of the configuration menu includes the high-alarm-light span;

the high-alarm-light span is the signal level difference between the alarm setpoint and the high-alarm-light setpoint;

the factory default setting of the high-alarm-light setpoint is ten signal units;

the local system computer is adapted for user technician configurational adjustment of the high-alarm-light span between a minimum value of four signal units to a maximum value of twenty signal units;

the high-alarm-light span is displayed on the display screen during the high-alarm-light span adjustment;

the raise pushbutton is adapted to be pressed to raise the high-alarm-light span to a maximum value of twenty signal units while the lower pushbutton is adapted to be pressed to lower the high-alarm-light span to a minimum value of four signal units;

pressing the test pushbutton saves the high-alarm-light span value into the memory of the local system computer and scrolls the configuration menu into the warning-message enable/disable selection mode;

the plurality of configuration items of the configuration menu includes the warning-message enable/disable adjustment mode;

the warning-message is a factory default voice message that follows a warning consisting of one very long, very low frequency beep pattern that is activated whenever the signal level indication on the display screen is greater than the warning setpoint but is lower than the high-warning setpoint;

the factory default configuration setting of the warning-message enable/disable mode is enabled;

the warning-message enable/disable status is displayed on the display screen during the selection process;

the raise pushbutton is adapted to be pressed to enable the warning-message while the lower pushbutton is adapted to be pressed to disable the warning-message;

pressing the test pushbutton saves the warning-message enable/disable setting into the memory of the local system computer and the remote computer and scrolls to the configuration menu for the high-warning-message enable/disable selection mode;

the plurality of configuration items of the configuration menu includes the high-warning-message enable/disable adjustment mode;

the high-warning-message is a factory default voice message that follows a high-warning consisting of two long, low frequency beep pattern that is activated whenever the signal level indication on the display screen is greater than the high-warning setpoint but is lower than the alarm setpoint;

the factory default configuration setting of the high-warning-message enable/disable mode is enabled;

the high-warning-message enable/disable status is displayed on the display screen during the selection process;

the raise pushbutton is adapted to be pressed to enable the high-warning-message while the lower pushbutton is adapted to be pressed to disable the high-warning-message;

pressing the test pushbutton saves the high-warning-message enable/disable setting into the memory of the local system computer and remote system computer and scrolls to the configuration menu for the alarm-message enable/disable selection mode;

the plurality of configuration items of the configuration menu includes the alarm-message enable/disable adjustment mode;

the alarm-message is a factory default voice message that follows an alarm consisting of three short, high-frequency beep pattern that is activated whenever the signal level indication on the display screen is greater than the alarm setpoint but is lower than the high-alarm setpoint;

the factory default configuration setting of the alarm-message enable/disable mode is enabled;

the alarm-message enable/disable status is displayed on the display screen during the selection process;

the raise pushbutton is adapted to be pressed to enable the alarm-message while the lower pushbutton is adapted to be pressed to disable the alarm-message;

pressing the test pushbutton saves the alarm-message enable/disable setting into the memory of the local system computer and scrolls to the configuration menu for the high-alarm-message enable/disable selection mode;

the plurality of configuration items of the configuration menu includes the high-alarm-message enable/disable adjustment mode;

the high-alarm-message is a factory default voice message that follows a high-alarm consisting of four very short, very high-frequency beep pattern that is activated whenever the signal level indication on the display screen is greater than the high-alarm setpoint;

the factory default configuration setting of the high-alarm-message enable/disable mode is enabled;

the high-alarm-message enable/disable status is displayed on the display screen during the selection process;

the high-alarm-message enable/disable status is displayed on the display screen during the selection process;

the raise pushbutton is adapted to be pressed to enable the high-alarm-message while the lower pushbutton is adapted to be pressed to disable the high-alarm-message;

pressing the test pushbutton saves the high-alarm-message enable/disable setting into the memory of the local system computer and scrolls to the configuration menu for the startup-message enable/disable selection mode;

the plurality of configuration items of the configuration menu includes the startup-message enable/disable selection mode;

the startup message is a factory default voice message that is annunciated when the local panel is energized;

the factory default configuration setting of the startup-message enable/disable is enabled;

the startup message enable/disable status is displayed on the display screen during the selection process;

the raise pushbutton is adapted to be pressed to enable the startup message while the lower pushbutton is adapted to be pressed to disable the startup message;

pressing the test pushbutton saves the alarm-message enable/disable setting into the memory of the local system computer and scrolls to the configuration menu for the line-contact-message-length selection mode;

the plurality of configuration items of the configuration menu includes the line-contact-message-length;

the line-contact message is a factory default voice message that follows a line-contact alarm consisting of one of the four line-contact alarm types that is actuated whenever the line-contact antenna senses the existence of a high-voltage electric potential on the vehicle relative to the potential of the ground immediately under the vehicle;

the factory default setting of the line-contact-message-length is ten seconds;

the line-contact-message-length is displayed on the display screen during the line-contact-message-length adjustment;

the raise pushbutton is adapted to be pressed to raise the line-contact-message-length value to a maximum value of sixteen seconds in increments of two seconds while the lower pushbutton is adapted to be pressed to lower the line-contact-message-length value to a minimum value of four seconds in increments of two seconds;

pressing the test pushbutton saves the line-contact-message-length into the memories of the local system computer and the remote system computer and scrolls to the configuration menu for the line-contact-alarm type selection mode;

the plurality of configuration items of the configuration menu of the configuration menu includes the line-contact-alarm type selection;

the line-contact-alarm is one-of-four possible alarm types that precedes the line-contact voice message that is actuated whenever the line-contact antenna senses the existence of a high-voltage electric potential on the vehicle relative to the potential of the ground immediately under the vehicle;

line-contact-alarm type one consists of a sequence of eight alternating high-frequency tones and low-frequency tones;

line-contact-alarm type two consists of a series of eight rising frequency whoops;

line-contact-alarm type three consists of a series of eight wailing tones;

line-contact-alarm type four consists of an eight second wailing tone;

the default line-contact-alarm type is type one;

the line-contact-alarm type is displayed on the display screen during the selection process;

the raise pushbutton is adapted to be pressed to raise the value of the line-contact-alarm type to a maximum value of four while the lower pushbutton is adapted to be pressed to lower the value of the line-contact-alarm type to a minimum value of one;

pressing the test pushbutton saves the line-contact-alarm type selection into the memories of the local system computer and the remote system computer and scrolls to the configuration menu for the antenna-gain selection;

the plurality of configuration items of the configuration menu includes the antenna-gain selection mode;

the antenna-gain selection provides a means to adjust the signal level indication for a given antenna configuration and distance from high-voltage lines;

the factory default setting of the antenna-gain setting is low;

the local system computer is adapted for user technician configurational adjustment of the three antenna-gain settings of low, medium and high;

an increase of the antenna-gain setting from low to medium would result in an increase in the signal level indication on the display screen by fifty percent;

increasing the antenna-gain setting from medium to high would result in an additional increase in the signal level indication on the display screen by thirty-three percent;

the antenna-gain setting status is displayed on the display screen during the selection process;

the raise pushbutton is adapted to be pressed to scroll upwardly through the antenna-gain settings while the lower pushbutton is adapted to pressed to scroll downwardly through the antenna-gain settings;

pressing the test pushbutton saves the antenna-gain setting into the memory of the local system computer and scrolls to the configuration menu for the line-contact setpoint;

the plurality of the configuration items of the configuration menu includes the line-contact alarm setpoint adjustment mode;

the line-contact alarm setpoint is set at a factory default value of fifteen line-contact signal units;

the line-contact alarm setpoint is set after the line-contact sensor portion of the line-contact antenna is installed on a protected underside of vehicle;

the first line of the display screen represents the line-contact signal level that would occur if the vehicle was in contact with a high voltage source;

the second line of the display screen represents the line-contact alarm setpoint;

the line-contact alarm sequence is initiated whenever the line-contact signal level exceeds the line-contact alarm setpoint;

the line-contact alarm setpoint is adjusted by momentarily applying a one-hundred-and-fifteen volt signal to the vehicle and noting the value of the line-contact signal level on the first line of the display screen;

the raise pushbutton is adapted to be pressed to raise the line-contact alarm setpoint to a setting of approximately four line-contact signal units below the noted line-contact signal level;

the lower pushbutton is adapted to be pressed to lower the line-contact alarm setpoint;

the adjustment span of the line-contact alarm setpoint is adjustable from a minimum of one line-contact signal unit to a maximum of forty line-contact signal units;

pressing the test pushbutton saves the line-contact alarm setpoint into the memory of the local system computer and scrolls the configuration menu into the maximum alarm setpoint selection mode;

the plurality of configuration items in the configuration mode includes message playing and recording;

while in the configuration mode, the local system computer and the remote system computer are adapted for playing all of the individual warnings or alarms along with their associated voice messages, and for recording all of the voice messages with an optional microphone plugged into the microphone jack located on the remote panel;

alarms and warnings with their associated messages are played by momentarily pressing one of the associated message test pushbuttons located on the remote panel; and messages are recorded by first pressing the play/record pushbutton followed by momentarily pressing at least one message pushbutton and recording while the play/record light is lighted at which time the at least one message pushbutton may be released.

* * * * *